US011149404B2

(12) United States Patent
Suzuki et al.

(10) Patent No.: US 11,149,404 B2
(45) Date of Patent: Oct. 19, 2021

(54) WORK MACHINE

(71) Applicant: HITACHI CONSTRUCTION MACHINERY CO., LTD., Tokyo (JP)

(72) Inventors: Yusuke Suzuki, Tsuchiura (JP); Hiroaki Tanaka, Kasumigaura (JP); Hisami Nakano, Tsuchiura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 231 days.

(21) Appl. No.: 16/490,995

(22) PCT Filed: Mar. 28, 2018

(86) PCT No.: PCT/JP2018/013014
§ 371 (c)(1),
(2) Date: Sep. 4, 2019

(87) PCT Pub. No.: WO2019/186940
PCT Pub. Date: Oct. 3, 2019

(65) Prior Publication Data

US 2020/0224384 A1 Jul. 16, 2020

(51) Int. Cl.
*E02F 3/43* (2006.01)
*E02F 3/32* (2006.01)
(Continued)

(52) U.S. Cl.
CPC ..... *E02F 3/435* (2013.01); *E02F 3/32* (2013.01); *E02F 9/02* (2013.01); *E02F 9/121* (2013.01);
(Continued)

(58) Field of Classification Search
CPC . E02F 9/121; E02F 3/435; E02F 9/123; E02F 9/2207; E02F 9/2271; E02F 9/2203; E02F 9/2033; F15B 2211/75
See application file for complete search history.

(56) References Cited

U.S. PATENT DOCUMENTS

2014/0121840 A1 5/2014 Mizuochi et al.

FOREIGN PATENT DOCUMENTS

JP 07-180192 A 7/1995
JP 6023053 B2 11/2016
(Continued)

OTHER PUBLICATIONS

International Search Report of PCT/JP2018/013014 dated May 29, 2018.

(Continued)

*Primary Examiner* — Abiy Teka
(74) *Attorney, Agent, or Firm* — Mattingly & Malur, PC

(57) ABSTRACT

It is determined whether a velocity estimation model is established from an actual operating velocity Vr and a target operating velocity Vt of each of actuators 20A, 21A, and 22A; in a case in which the velocity estimation model is established, a dynamic center-of-gravity position of a hydraulic excavator 1 in a case in which each of the actuators 20A, 21A, and 22A is suddenly stopped from a driven state is predicted from an estimated operating velocity Ve; in a case in which the velocity estimation model is not established, the dynamic center-of-gravity position is predicted from the actual operating velocity Vr and it is determined whether to execute control intervention using the predicted dynamic center-of-gravity position; and in a case in which it is determined to execute the control intervention, the target operating velocity Vt is corrected in such a manner that each of the actuators 20A, 21A, and 22A slowly decelerate. It is thereby possible to appropriately carry out operating velocity limiting on a front work implement 2 and slow deceleration of the front work implement 2 and to suppress reductions in workability and operability, a deterioration in a ride quality, and the like even in a case of work (Continued)

involving an abrupt change in disturbance or a change in the lever operation amount within minute time.

4 Claims, 10 Drawing Sheets

(51) Int. Cl.

| | |
|---|---|
| ***E02F 9/02*** | (2006.01) |
| ***E02F 9/12*** | (2006.01) |
| ***E02F 9/20*** | (2006.01) |
| ***E02F 9/22*** | (2006.01) |
| ***F15B 21/08*** | (2006.01) |

(52) U.S. Cl.
CPC ..... *E02F 9/2004* (2013.01); *E02F 9/2033* (2013.01); *E02F 9/22* (2013.01); *F15B 21/08* (2013.01); *F15B 2211/75* (2013.01); *F15B 2211/782* (2013.01)

(56) References Cited

FOREIGN PATENT DOCUMENTS

| | | | |
|---|---|---|---|
| JP | 2017-008501 | A | 1/2017 |
| JP | 2017-179929 | A | 10/2017 |
| WO | 2010/101235 | A1 | 9/2010 |
| WO | 2014/013877 | A1 | 1/2014 |

OTHER PUBLICATIONS

International Preliminary Report on Patentability received in corresponding International Application No. PCT/JP2018/013014 dated Oct. 8, 2020.

WORK MACHINE

TECHNICAL FIELD

The present invention relates to a work machine.

BACKGROUND ART

As a work machine for use in structure demolition work, waste disposal, scrap handling, roadworks, construction work, civil engineering work, and the like, there is known a work machine that is configured with a swing structure swingably attached to an upper portion of a truck structure running by a power system and a multijoint front work implement vertically rockably attached to the swing structure, and that drives a plurality of front implement members configuring the front work implement by cylinders. For example, a hydraulic excavator that is a kind of work machine has a front work implement configured from a plurality of front implement members such as a boom, an arm, and a bucket, and drives the plurality of front implement members by a boom cylinder, an arm cylinder, and a bucket cylinder, respectively.

The work machine, such as this hydraulic excavator, having the front work implement drives each movable section in response to an operation content of one of operation levers; thus, when the operation lever is instantaneously returned to a neutral position from an operation state, the movable section driven in response to an operation on the operation lever is suddenly stopped and an inertial force in response to a deceleration at the time of the sudden stop is produced. When the front work implement is suddenly stopped, then part of the track structure often floats from a ground by the inertial force, and the entire work machine often tilts. In a case in which part of the track structure floats from the ground and the entire work machine tilts, then the track structure strikes against the ground when the work machine returns to an original posture, thereby presumably applying an intense vibration or impact to a driver of the work machine. This possibly deteriorates a ride quality and, at worst, causes tipping-over of the work machine by the inertial force at the time of the sudden stop of the front work implement.

To address the problem, there is proposed a technique for estimating, in real time, dynamic stability related to floating of the work machine using a ZMP (Zero Moment Point) indicating a dynamic center-of-gravity position of the work machine, and limiting operating velocities of the front work implement or slowly decelerating the front work implement in a case of estimating that there is a high probability that the work machine tilts from this dynamic stability, thereby suppressing the work machine from tilting.

Patent Document 1, for example, discloses a work machine configured with a track structure, a work machine body attached to the track structure, a front work implement vertically rockably attached to the work machine body, each movable section in the track structure, the work machine body, and the front work implement, an actuator driving the movable section, and a controller controlling the actuator to be driven, the controller being configured with velocity estimation means that estimates a velocity of the movable section in response to an operation amount of an operation lever operating the actuator in any of the track structure, the work machine body, and the front work implement; behavior prediction means that predicts a position locus that is a displacement of the actuator, a velocity locus that is a change in a velocity of the actuator, and an acceleration locus that is a change in an acceleration of the actuator during a time period in which the actuator is stopped from a driven state in a case in which the operation lever is returned to a stop command position from an operation state on the basis of the estimated velocity estimated by the velocity estimation means; stability controlling computing means that predicts whether the work machine becomes unstable before the actuator is stopped in response to the position locus, the velocity locus, and the acceleration locus obtained by the behavior prediction means, and that calculates an operation limiting value for stabilizing the work machine until the actuator is stopped; and command value generation means that generates command information to the actuator which drives the movable section on the basis of a computing result of the stability controlling computing means.

PRIOR ART DOCUMENT

Patent Document

Patent Document 1: Japanese Patent No. 6023053

SUMMARY OF THE INVENTION

Problem to be Solved by the Invention

In the conventional technique, while it is predicted that a velocity estimation model changes moment by moment depending on an engine speed, a magnitude of a load, a posture, a fluid temperature, and the like, it is assumed that a change in a work situation is small and a change in the velocity estimation model is also small within minute time, and velocity limiting on and slow deceleration of the front work implement are carried out on the basis of the velocity estimated by this velocity estimation model.

However, the hydraulic excavator often performs work involving an abrupt change in disturbance and a change in the lever operation amount within the minute time, for example, rolling compaction work (so-called bumping work) for moderately compacting the ground by vertically moving the boom and the arm in a fixed rhythm and quickly operating the boom and the arm in the vicinity of the ground. In the bumping work, the hydraulic excavator rolls and compacts the ground by raising the front work implement in a stopped state by a sudden raising operation and then performing a sudden lowering operation to moderately strike the bucket against the ground.

In the conventional technique, therefore, in a case of performing the work, such as the bumping work, involving the abrupt change in disturbance and the change in the lever operation amount within the minute time, the velocity estimation model is not established. In other words, if the velocity estimation model is not established, it is impossible to obtain an accurate ZMP. Owing to this, control intervention such as slow deceleration of or velocity limiting on the front work implement is not performed properly, and an increase in a braking distance of the front work implement, floating of a machine body due to lack of the velocity limiting, and the like are predicted. As a result, the front work implement operates differently from driver's prediction, possibly resulting in great reductions in workability and operability and a deterioration in a ride quality.

The present invention has been achieved in the light of the above respects, and an object of the present invention is to provide a work machine that can appropriately carry out limiting on operating velocities of a front work implement and slow deceleration of the front work implement and that can suppress reductions in workability and operability, a deterioration in a ride quality, and the like even in a case of work involving an abrupt change in disturbance and a change in a lever operation amount within minute time.

Means for Solving the Problem

While the present application includes a plurality of means for solving the problem, an example of the plurality of means is as follows. A work machine according to the present invention is a work machine including: a track structure; a swing structure swingably attached onto the track structure; a multijoint front work implement that is configured by coupling a plurality of driven members in such a manner as to be rotatable in a perpendicular direction and that is supported by the swing structure in such a manner as to be rotatable in the perpendicular direction; a plurality of actuators that drive the plurality of driven members of the front work implement, respectively; a plurality of motion information sensors that detect information regarding motions of the plurality of driven members that configure the swing structure and the front work implement during operations of the plurality of driven members; and a controller that controls the plurality of actuators to be driven, in which the controller includes a target operating velocity generation section that generates a target operating velocity of each of the plurality of actuators on the basis of an operation signal generated in response to an operation amount of an operation lever operating the actuator; an operating velocity detection section that detects an actual operating velocity of each of the plurality of actuators on the basis of each of the information regarding the motions of the motions of the plurality of driven members detected by the motion information sensors; an operating velocity estimation section that estimates an operating velocity of each of the plurality of actuators on the basis of a velocity estimation model set in advance from the target operating velocity and the actual operating velocity; a first center-of-gravity position prediction section that predicts a dynamic center-of-gravity position of the work machine in a case in which each of the plurality of actuators is suddenly stopped from a driven state, using the operating velocity of each of the plurality of actuators estimated by the operating velocity estimation section; a control intervention determination section that determines whether to execute control intervention to correct the target operating velocity on the basis of the dynamic center-of-gravity position; a target operating velocity correction section that corrects the target operating velocity generated by the target operating velocity generation section in such a manner as to suppress floating of the work machine; a drive command section that controls each of the plurality of actuators to be driven on the basis of the target operating velocity corrected by the target operating velocity correction section; a velocity estimation model establishment/non-establishment determination section that determines whether the velocity estimation model is established on the basis of a result of comparing the actual operating velocity detected by the operating velocity detection section with the target operating velocity generated by the target operating velocity generation section; and a second center-of-gravity position prediction section that predicts a dynamic center-of-gravity position of the work machine in a case in which each of the plurality of actuators is suddenly stopped from the driven state, using the actual operating velocity of each of the plurality of actuators detected by the operating velocity detection section, the control intervention determination section determines whether to execute the control intervention using the dynamic center-of-gravity position predicted by the second center-of-gravity position prediction section as an alternative to the dynamic center-of-gravity position predicted by the first center-of-gravity position prediction section in a case in which the velocity estimation model establishment/non-establishment determination section determines that the velocity estimation model is not established, and the target operating velocity correction section corrects the target operating velocity in such a manner that each of the plurality of actuators slowly decelerates by limiting a deceleration rate of the target operating velocity in a case in which the control intervention determination section determines to execute the control intervention.

Advantages of the Invention

According to the present invention, even in a case in which a cylinder velocity estimation model is not established due to a sudden change in disturbance or a change in a lever operation amount within minute time, for example, in a case of bumping of the hydraulic excavator, it is possible to appropriately carry out operating velocity limiting on the front work implement and slow deceleration of the front work implement.

Furthermore, it is possible to appropriately carry out the operating velocity limiting on the front work implement and the slow deceleration of the front work implement without the need to add a sensor for detecting an external force or a complicated information process. From the foregoing, in a case in which there is a low probability that the work machine tilts, the front work implement can be actuated delicately and quickly while suppressing a deterioration in a ride quality due to floating of the work machine; thus, it is possible to improve workability and operability.

MODES FOR CARRYING OUT THE INVENTION

An embodiment of the present invention will be described hereinafter with reference to the drawings. While a hydraulic excavator configured with a front work implement will be exemplarily described as an example of a work machine in the present embodiment, the present invention is also applicable to a work machine such as a wheel loader other than the hydraulic excavator as long as the work machine is configured with a front work implement.

Figure 1:
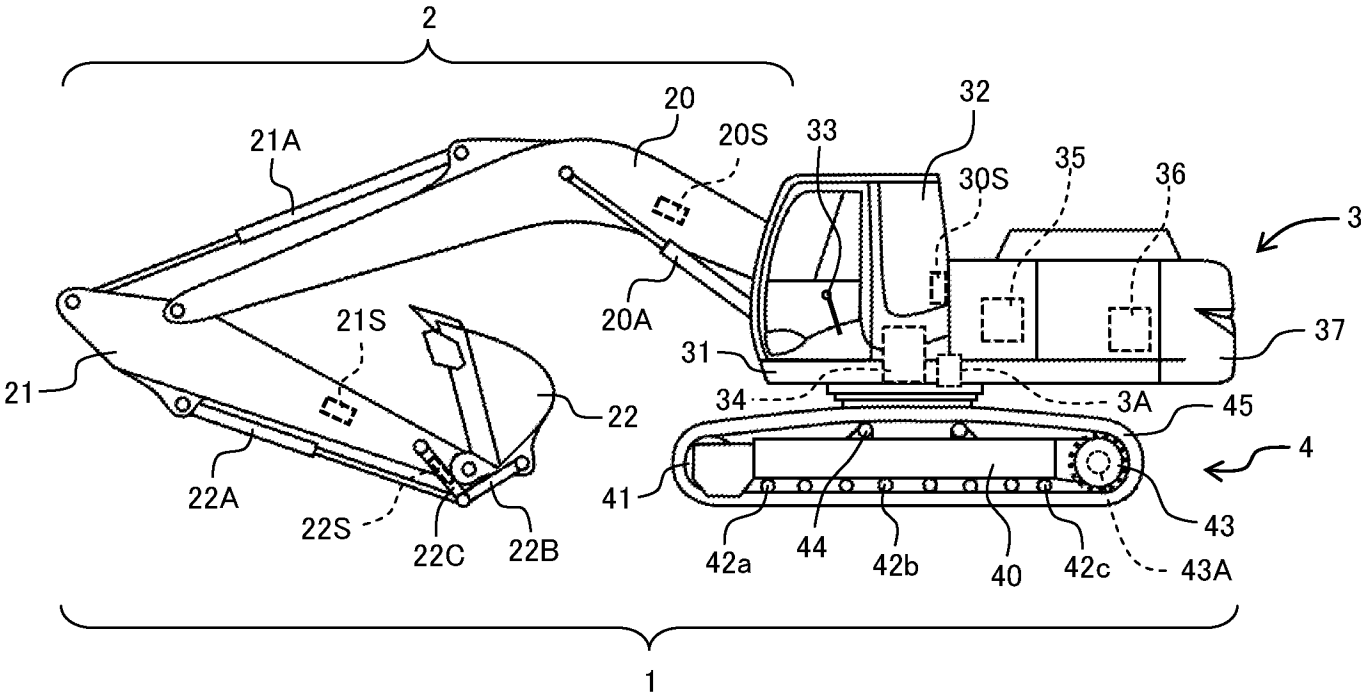
FIG. 1 is a side view schematically depicting an outward appearance of a hydraulic excavator that is an example of a work machine according to the present embodiment.
Figure 2:
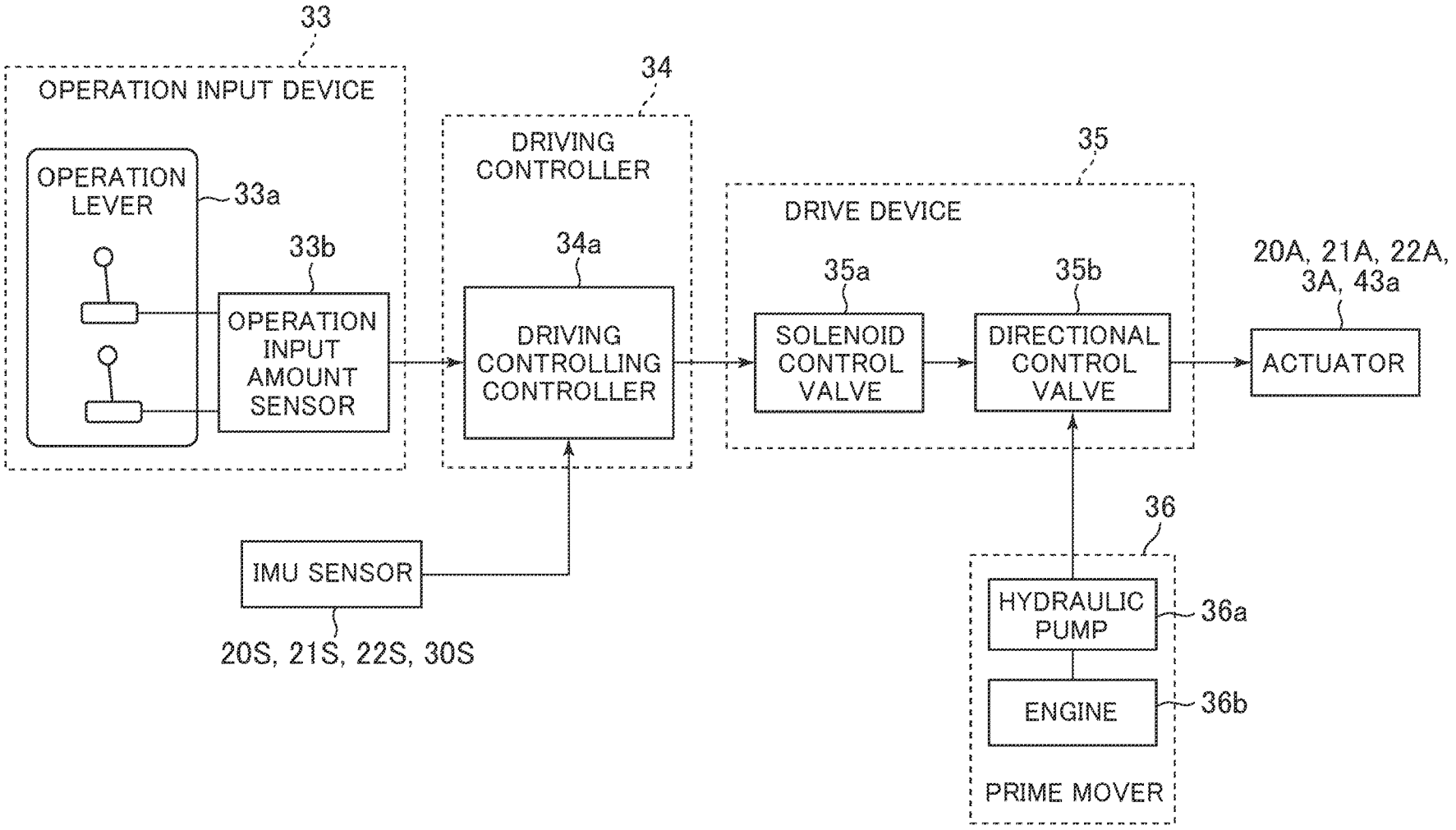
FIG. 2 is a diagram depicting a work machine control system according to the present embodiment together with associated configurations.

FIG. 1 is a side view schematically depicting an outward appearance of the hydraulic excavator that is an example of the work machine according to the present embodiment. In addition, FIG. 2 is a diagram depicting a work machine control system according to the present embodiment together with associated configurations.

Work Machine (Hydraulic Excavator 1)

As depicted in FIG. 1, a hydraulic excavator 1 that is an example of the work machine according to the present embodiment is configured with a track structure 4, a swing structure 3 swingably attached onto the track structure 4, a multijoint front work implement 2 that is configured by rotatably coupling a boom 20 and an arm 21 serving as driven members and a bucket 22 which is a work tool in a perpendicular direction and that is rotatably supported by the swing structure 3, a plurality of actuators (a boom cylinder 20A, an arm cylinder 21A, and a bucket cylinder 22A) driving the boom 20, the arm 21, and the bucket 22 of the front work implement 2, respectively.

The track structure 4 is configured with a track frame 40, and left and right front idlers 41, left and right lower rollers (front) 42*a*, left and right lower rollers (center) 42*b*, left and right lower rollers (rear) 42*c*, left and right sprockets 43, left and right upper rollers 44, left and right crawler belts 45, and left and right track hydraulic motors 43A (actuators) connected to the sprockets 43, all of which are provided on the track frame 40 in pairs. The front idlers 41, the lower rollers (front) 42*a*, the lower rollers (center) 42*b*, the lower rollers (rear) 42*c*, the sprockets 43, and the upper rollers 44 are disposed on the track frame 40, and the crawler belts 45 are installed in such a manner as to go around the track frame 40 by being wound around the track frame 40 via those members. It is noted that the numbers of the lower rollers (center) 42*b* and the upper rollers 44 can be changed depending on a magnitude of the track structure 4, so that more or less lower rollers (center) 42*b* and upper rollers 44 than those depicted in FIG. 1 can be disposed or no lower rollers (center) 42*b* or upper rollers 44 can be disposed. It is noted that the track structure 4 is not limited to that configured with the crawler belts but may be a track structure configured with track wheels and legs.

In the front work implement 2, a base end of the boom 20 is supported by a front portion of the swing structure 3 in such a manner as to be rotatable in the perpendicular direction, one end of the arm 21 is supported by an end portion (tip end portion) of the boom 20 other than the base end thereof in such a manner as to be rotatable in the perpendicular direction, and the bucket 22 is supported by the other end of the arm 21 in such a manner as to be rotatable in the perpendicular direction. A first link 22B and a second link 22C, one end of each of which is rotatably connected to one end of the other link, are disposed in a connection portion in which the arm 21 is connected to the bucket 22, the other end (end portion other than that connected to the second link 22C) of the first link 22B is rotatably connected to the bucket 22, and the other end (end portion other than that connected to the first link 22B) is rotatably connected to the arm 21.

Furthermore, in the front work implement 2, a bottom side and a rod side of the boom cylinder 20A are rotatably coupled with the swing structure 3 and the boom 20, respectively, a bottom side and a rod side of the arm cylinder 21A are rotatably coupled with the boom 20 and the arm 21, respectively, and a bottom side and a rod side of the bucket cylinder 22A are rotatably coupled with the arm 21 and a coupling portion in which the first and second links 22B and 22C are coupled with each other, respectively. The boom cylinder 20A, the arm cylinder 21A, and the bucket cylinder 22A expand and contract by hydraulic pressures, thereby driving the boom 20, the arm 21, and the bucket 22 to rotate, respectively. It is noted that the bucket 22 can be freely replaced by the other work tool, which is not depicted, such as a grapple, a breaker, a ripper, or a magnet.

The swing structure 3 is configured with a cabin 32, an operation input device 33, a driving controller 34, a drive device 35, a prime mover 36, and a counterweight 37 that are disposed on a main frame 31. The main frame 31 swingably connected to the track structure 4 is driven to swing by a swing hydraulic motor 3A (actuator), thereby driving the entire swing structure 3 to swing. The counterweight 37 is used to achieve the balance of weight necessary at a time of running the hydraulic excavator 1, and disposed in a rear portion of the swing structure 3 as opposed to the front work implement 2 disposed in a front portion of the swing structure 3.

Control System

In FIG. 2, a control system of the hydraulic excavator 1 according to the present embodiment is generally configured with the operation input device 33 that generates operation signals for operating the actuators 20A, 21A, 22A, 3A, and 43A and that outputs the operation signals to the driving controller 34, IMU sensors 20S, 21S, 22S, and 30S that detect angular velocities and accelerations of the boom 20, the arm 21, the bucket 22, and the swing structure 3 and that output the angular velocities and accelerations to the driving controller 34, the drive device 35 that controls flow rates and directions of a hydraulic fluid supplied from the prime mover 36 to the actuators 20A, 21A, 22A, 3A, and 43A and that drives the actuators 20A, 21A, 22A, 3A, and 43A, and the driving controller 34 that generates control signals (control command values) for controlling the drive device 35 on the basis of the operation signals from the operation input device 33 and detection values of the IMU sensors 20S, 21S, 22S, and 30S and that outputs the control signals (control command signals) to the drive device 35. The operation input device 33, the IMU sensors 20S, 21S, 22S, and 30S, and the drive device 35 are connected to the driving controller 34 by signal lines.

Operation Input Device 33

The operation input device 33 that outputs the operation signals for operating the boom cylinder 20A, the arm cylinder 21A, and the bucket cylinder 22A of the front work implement 2, the swing hydraulic motor 3A of the swing structure 3, and the track hydraulic motors 43A of the track structure 4 is disposed in the cabin 32 in which an operator (driver) is on board. The operation input device 33 is configured with a pair of operation levers 33*a* for operating the front work implement 2 and the swing structure 3, a pair of operation levers (track pedals, not depicted) for operating the track structure 4, and an operation input amount sensor 33*b* that detects tilting amounts of those levers.

The pair of operation levers 33*a* for operating the front work implement 2 and the swing structure 3 are each tiltable forward, backward, leftward, and rightward. The operation input amount sensor 33*b* detects the operator's tilting amounts (operation amounts) of the operation levers 33*a*, generates electrical signals (operation signals) for operating the front work implement 2 and the swing structure 3 (that is, for operating the actuators 20A, 21A, 22A, and 3A) in response to the operation amounts, and outputs the electrical signals (operation signals) to a driving controlling controller 34*a* (refer to FIG. 2) that configures the driving controller 34 via an electrical interconnection. For example, an operation on each of the boom cylinder 20A, the arm cylinder 21A, the bucket cylinder 22A, and the swing hydraulic motor 3A is allocated to front and back directions or left and right directions of one of the operation levers 33*a*.

Likewise, the operation levers (track pedals, not depicted) for operating the track structure 4 are each tiltable in the front and back directions. The operation input amount sensor 33*b* detects the operator's tilting amounts (operation amounts) of the operation levers (track pedals), generates electrical signals (operation signals) for operating the track structure 4 (that is, for operating the track hydraulic motors 43A) in response to the operation amounts, and outputs the electrical signals (operation signals) to the driving controlling controller 34*a* (refer to FIG. 2) via an electrical interconnection. In other words, track operations on the hydraulic excavator 1 are allocated to the front and back directions of the operation levers (track pedals).

In other words, the operation input amount sensor 33*b* detects operating velocities (that is, target operating velocities) of the boom cylinder 20A, the arm cylinder 21A, the bucket cylinder 22A, the swing hydraulic motor 3A, and the track hydraulic motors 43A demanded by the operator by operating the operation levers 33*a* (including the track pedals), and outputs the operating velocities to the driving controller 34 as the operation signals. In the hydraulic excavator 1, the operating velocities of the actuators 20A, 21A, 22A, 3A, and 43A are set to be faster as the amounts of tilting the operation levers 33*a* (operation amounts) are larger. By operator's adjusting the amounts of tilting the operation levers 33*a*, the operating velocities of the actuators 20A, 21A, 22A, 3A, and 43A are adjusted to cause the hydraulic excavator 1 to operate.

It is noted that the operation input device 33 may be a hydraulic pilot type operation input device that outputs tilting amounts and tilting directions of the operation levers as operation signals by a pilot pressure. In a case of adopting this hydraulic pilot type operation input device, a sensor that detects the pilot pressure by a hydraulic operating fluid may be used as the operation input amount sensor for detecting the operation amounts of the operation levers 33*a* and the like.

Prime Mover 36

The prime mover 36 is configured with an engine 36*b* serving as a prime mover and a hydraulic pump 36*a* driven by the engine 36*b*, and generates a hydraulic fluid necessary to drive the actuators 20A, 21A, 22A, 3A, and 43A.

Drive Device 35

The drive device 35 is configured with a solenoid control valve 35*a* and a directional control valve 35*b*. Operating control over the boom cylinder 20A, the arm cylinder 21A, the bucket cylinder 22A, the swing hydraulic motor 3A, and the track hydraulic motors 43A is exercised by causing the directional control valve 35*b* to control directions and flow rates of the hydraulic operating fluid supplied from the hydraulic pump 36*a* driven by the engine 36*b* that serves as the prime mover to the boom cylinder 20A, the arm cylinder 21A, the bucket cylinder 22A, the swing hydraulic motor 3A, and the track hydraulic motors 43A. A spool of the directional control valve 35*b* is driven by a drive signal (pilot pressure) generated from a delivery pressure of a pilot pump (not depicted) via the solenoid control valve 35*a*. Currents generated by the driving controller 34 on the basis of the operation signals from the operation input amount sensor 33*b* in the operation input device 33 are input to the solenoid control valve 35*a* as the control signals (control command values), thereby controlling the boom cylinder 20A, the arm cylinder 21A, the bucket cylinder 22A, the swing hydraulic motor 3A, and the track hydraulic motors 43A to operate.

IMU Sensors 20S, 21S, 22S, 30S

The IMU (Inertial Measurement Unit) sensor (for boom) 20S for detecting the angular velocity associated with an operation of the boom 20 of front work implement 2 and the acceleration acting on the boom 20 is disposed in the boom 20. Likewise, the IMU sensor (for arm) 21S for detecting the angular velocity associated with an operation of the arm 21 and the acceleration acting on the arm 21 is disposed in the arm 21, and the IMU sensor (for bucket) 22S for detecting the angular velocity associated with an operation of the second link 22C and the acceleration acting on the second link 22C is disposed in the second link 22C. The IMU sensors 20S, 21S, and 22S are inertial measurement units, and have a function as angular velocity sensors that measure the angular velocities associated with the operations of the objects to which the IMU sensors 20S, 21S, and 22S are relatively fixed and that output measurement results as angular velocity signals, and a function as acceleration sensors that measure the accelerations acting on the objects and that output measurement results as acceleration signals. Furthermore, the IMU sensor (for swing structure) 30S detecting an inclination of the swing structure 3 with respect to a ground is disposed in the swing structure 3. The IMU sensor (for swing structure) 30S is an inertial measurement unit similar to the IMU sensors 20S, 21S, and 22S, and has a function as an angular velocity sensor and a function as an acceleration sensor. In other words, the IMU sensors 20S, 21S, 22S, and 30S may be rephrased as motion information sensors that detect information related to motions such as the angular velocities and the accelerations when the boom 20, the arm 21, the bucket 22, and the swing structure 3 operate, as motion information.

Since the boom 20, the arm 21, the bucket 22, the boom cylinder 20A, the arm cylinder 21A, the bucket cylinder 22A, the first link 22B, the second link 22C, and the swing structure 3 are connected in such a manner as to be rockable, it is possible to calculate postures (for example, relative angles formed with a horizontal surface) of the boom 20, the arm 21, the bucket 22, and the swing structure 3 and the operating velocities of the boom cylinder 20A, the arm cylinder 21A, and the bucket cylinder 22A from detection results (motion information: angular velocities and accelerations) of the IMU sensors 20S, 21S, 22S, and 30S and a mechanical link relationship.

Since the swing structure 3 and the track structure 4 rotate only in XY plane directions in an XYZ coordinate system to be described later, the IMU sensor (for swing structure) 30S is installed only in the swing structure 3 and the swing structure 3 and the track structure 4 are handled as having the same posture in the present embodiment. Alternatively, an IMU sensor (for track structure) may be installed in the track structure 4 similarly to the other members, and a dynamic center-of-gravity position may be calculated in the light of a posture and an operating velocity of the track structure 4 at a track-structure center of gravity 4G. Moreover, methods of detecting the postures and the operating velocities described herein are given as an example, and the IMU sensors 20S, 21S, 22S, and 30S may be configured to directly measure relative angles of the driven members (boom 20, arm 21, and bucket 22) of the front work implement 2, or configured to detect strokes and velocities of the boom cylinder 20A, the arm cylinder 21A, and the bucket cylinder 22A and to calculate the postures and the operating velocities of the driven members of the front work implement 2.

Driving Controller 34

The driving controlling controller 34*a* that configures the driving controller 34 is configured with a central processing unit (CPU) that is an input section and a processor, a read only memory (ROM) and a random access memory (RAM) that are storage devices, an output section, and the like although not depicted. The signals from the operation input device 33 and the signals from the IMU sensors 20S, 21S, 22S, and 30S are input to the input section, and the input section performs A/D conversion. The ROM is a storage medium that stores therein a control program for executing flowcharts of FIGS. 9 and 10 to be described later, various information necessary to execute the flowcharts, and the like, while the CPU performs a predetermined computing process on the signals imported from the input section and the memory in accordance with the control program stored in the ROM. The output section creates signals for output (for example, currents as the control command values) in response to a computing result of the CPU and outputs the signals to the drive device 35, thereby driving and controlling a plurality of actuators (boom cylinder 20A, arm cylinder 21A, bucket cylinder 22A, swing hydraulic motor 3A, and track hydraulic motors 43A). While a case in which the driving controlling controller 34*a* is configured with semiconductor memories that are the ROM and the RAM as the storage devices is exemplarily described in the present embodiment, the semiconductor memories can be replaced by other devices as long as the devices are storage devices and the driving controlling controller 34*a* may be configured with, for example, magnetic storage devices such as a hard disk drive.

Figure 3:
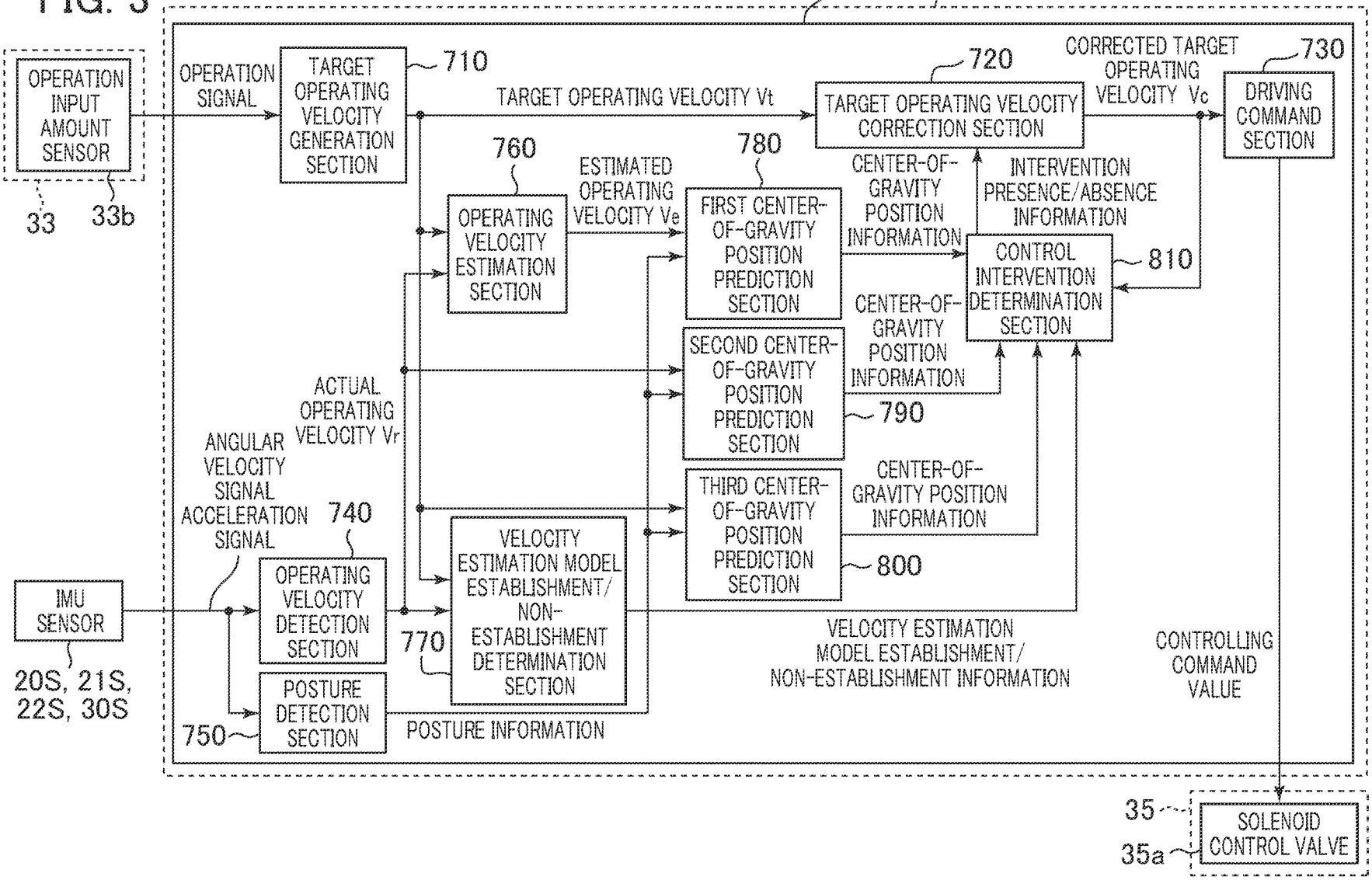
FIG. 3 is a functional block diagram depicting processes by a driving controlling controller.

FIG. 3 is a functional block diagram depicting processes by the driving controlling controller.

In FIG. 3, the driving controlling controller 34*a* is configured with a target operating velocity generation section 710, a target operating velocity correction section 720, a drive command section 730, an operating velocity detection section 740, a posture detection section 750, an operating velocity estimation section 760, a velocity estimation model establishment/non-establishment determination section 770, a first center-of-gravity position prediction section 780, a second center-of-gravity position prediction section 790, a third center-of-gravity position prediction section 800, and a control intervention determination section 810.

The target operating velocity generation section 710 generates a target operating velocity Vt of each of the boom cylinder 20A, the arm cylinder 21A, and the bucket cylinder 22A from the operation signals output from the operation input device 33 on the basis of the operation amounts of the operation levers 33*a*.

The operating velocity detection section 740 detects the operating velocities of the boom cylinder 20A, the arm cylinder 21A, and the bucket cylinder 22A on the basis of the mechanical link relationship held in advance using the detection results (angular velocities and acceleration signals) from the IMU sensors 20S, 21S, and 22S, and outputs the operating velocities each as an actual operating velocity Vr.

The posture detection section 750 detects posture information (for example, relative angles between a reference line connecting rotational portions on two ends of each driven member and the horizontal surface) about the boom 20, the arm 21, and the bucket cylinder 22A on the basis of the mechanical link relationship held in advance using the detection results (angular velocity signals and acceleration signals) from the IMU sensors 20S, 21S, 22S, and 30S, and outputs the posture information.

The operating velocity estimation section 760 estimates an operating velocity using a velocity estimation model on the basis of the target operating velocity Vt generated by the target operating velocity generation section 710 for each of the boom cylinder 20A, the arm cylinder 21A, and the bucket cylinder 22A and the actual operating velocity Vr detected by the operating velocity detection section 740 for each of the boom cylinder 20A, the arm cylinder 21A, and the bucket cylinder 22A, and outputs the operating velocity as an estimated operating velocity Ve.

The velocity estimation model establishment/non-establishment determination section 770 determines whether a velocity estimation model is established for the operation of the hydraulic excavator 1, that is, makes a velocity estimation model establishment/non-establishment determination on the basis of a velocity difference between the target operating velocity Vt generated by the target operating velocity generation section 710 and the actual operating velocity Vr detected by the operating velocity detection section 740, and outputs a determination result as velocity estimation model establishment/non-establishment information. In other words, the velocity estimation model establishment/non-establishment determination section 770 makes the velocity estimation model establishment/non-establishment determination, and outputs either velocity estimation model establishment/non-establishment information (established) indicating that the velocity estimation model is established or velocity estimation model establishment/non-establishment information (not established) indicating that the velocity estimation model is not established as the velocity estimation model establishment/non-establishment information. It is noted that the velocity estimation model establishment/non-establishment determination section 770 performs the velocity estimation model establishment/non-establishment determination by comparing the velocity difference between the target operating velocity Vt and the actual operating velocity Vr with a predetermined threshold (to be described later in detail). While a case of determining whether the velocity estimation model is established by comparing the velocity difference between the target operating velocity Vt and the actual operating velocity Vr with the predetermined threshold for one specific actuator (for example, boom cylinder 20A) out of the plurality of actuators 20A, 21A, 22A, 3A, and 43A is supposed in the present embodiment, it may be determined whether the velocity estimation model is established by comparing the velocity difference between the target operating velocity Vt and the actual operating velocity Vr with a predetermined threshold set in advance for each of the plurality of actuators 20A, 21A, and 22A, and determining whether the velocity difference for any of the plurality of actuators 20A, 21A, and 22A exceeds the predetermined threshold.

The first center-of-gravity position prediction section 780 computes a dynamic center-of-gravity position of the hydraulic excavator 1 in a case in which the front work implement 2 is suddenly stopped, from the estimated operating velocity Ve estimated by the operating velocity estimation section 760 and the posture information detected by the posture detection section 750, and outputs the dynamic center-of-gravity position as center-of-gravity position information. The case in which the front work implement 2 is suddenly stopped is a case in which the actuators 20A, 21A, and 22A each in a driven state in response to operation contents of the operation levers 33*a* are suddenly stopped due to return of the operation levers 33*a* instantaneously to neutral positions from operation states, and inertial forces in response to decelerations are generated in the driven members 20, 21, and 22 at the time of sudden stop.

The second center-of-gravity position prediction section 790 computes a dynamic center-of-gravity position of the hydraulic excavator 1 in the case in which the front work implement 2 is suddenly stopped, from the actual operating velocity Vr detected by the operating velocity detection section 740 and the posture information detected by the posture detection section 750, and outputs the center-of-gravity position as center-of-gravity position information.

The third center-of-gravity position prediction section 800 computes a dynamic center-of-gravity position of the hydraulic excavator 1 in the case in which the front work implement 2 is suddenly stopped, from the target operating velocity Vt generated by the target operating velocity generation section 710 and the posture information detected by the posture detection section 750, and outputs the center-of-gravity position as center-of-gravity position information.

The control intervention determination section 810 determines whether to exercise each of control (velocity limiting control) to limit a maximum value of each operating velocity of the front work implement 2 by correcting the target operating velocity Vt in such a manner as to limit a maximum value of the target operating velocity Vt and control (slow deceleration control) to limit a deceleration of the front work implement 2 to slowly decelerate the front work implement 2 by correcting the target operating velocity Vt in such a manner as to limit a deceleration of the target operating velocity Vt (that is, whether to perform control intervention) on the basis of the center-of-gravity position information calculated by the first center-of-gravity position prediction section 780, the second center-of-gravity position prediction section 790, and the third center-of-gravity position prediction section 800 and a determination result (velocity estimation model establishment/non-establishment information) of the velocity estimation model establishment/non-establishment determination section 770, determines to exercise the control, and outputs a determination result (that is, whether to perform the control intervention) as intervention presence/absence information. In other words, the control intervention information output from the control intervention determination section 810 is one of the control intervention information (no control intervention) indicating that the control intervention is not performed, the control intervention information (velocity limiting control) indicating that only the velocity limiting control is exercised, the control intervention information (slow deceleration control) indicating that only the slow deceleration control is exercised, and the control intervention information(velocity limiting control and slow deceleration control) indicating that both the velocity limiting control and the slow deceleration control are exercised.

The target operating velocity correction section 720 carries out the velocity limiting control and the slow deceleration control over the target operating velocity Vt of each of the actuators 20A, 21A, and 22A on the basis of the intervention presence/absence information determined by the control intervention determination section 810, corrects the target operating velocity Vt, and outputs the corrected target operating velocity Vt as a corrected target operating velocity Vc. In other words, in a case of the intervention presence/absence information (velocity limiting control and slow deceleration control), the target operating velocity correction section 720 carries out the velocity limiting control and the slow deceleration control and outputs the corrected target operating velocity Vc that is the corrected target operating velocity Vt, in a case of the intervention presence/absence information (velocity limiting control), the target operating velocity correction section 720 carries out only the velocity limiting control and outputs the corrected target operating velocity Vc that is the corrected target operating velocity Vt, in a case of the intervention presence/absence information (slow deceleration control), the target operating velocity correction section 720 carries out only the slow deceleration control and outputs the corrected target operating velocity Vc that is the corrected target operating velocity Vt, and in a case of the intervention presence/absence information (no control intervention), the target operating velocity correction section 720 outputs the target operating velocity Vt as the corrected target operating velocity Vc as it is without carrying out the velocity limiting control and the slow deceleration control.

The drive command section 730 generates the currents for controlling the drive device 35 on the basis of the corrected target operating velocity Vc output from the target operating velocity correction section 720, and outputs the generated currents to the solenoid control valve 35*a* in the drive device 35 as the control command values.

Center-of-Gravity Position

Figure 4:
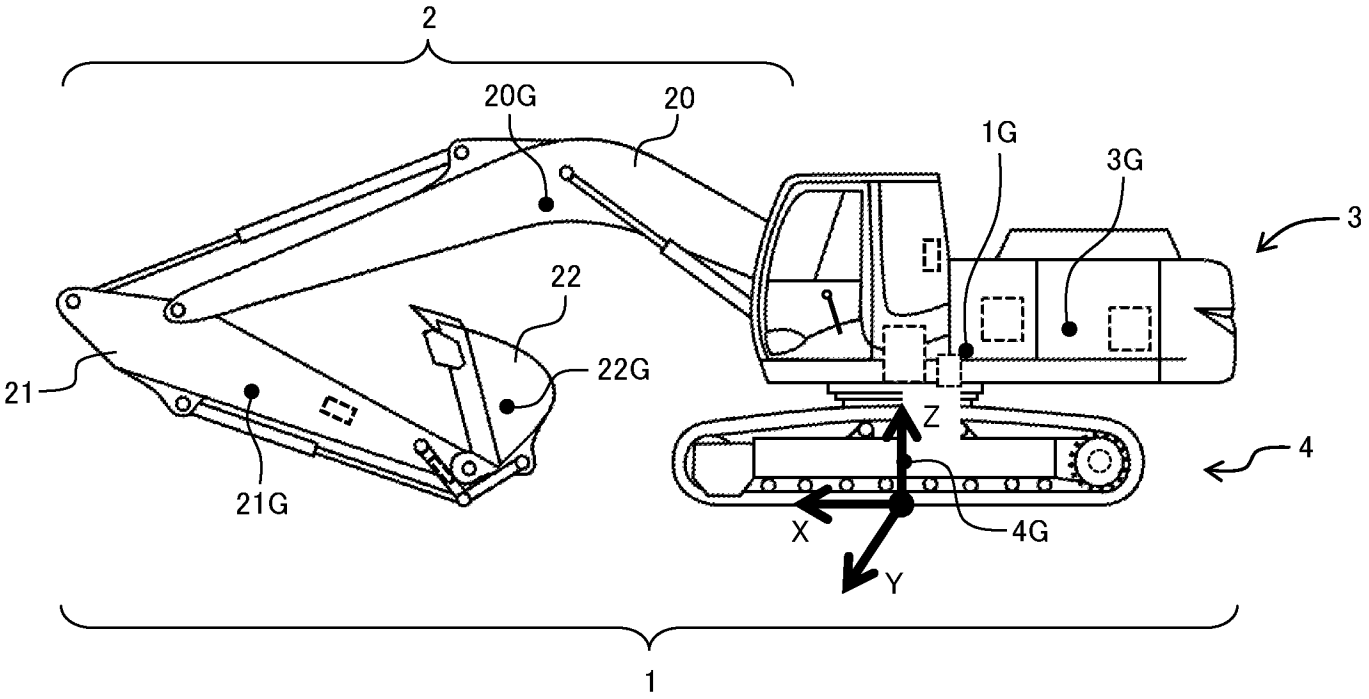
FIG. 4 is a side view describing a center-of-gravity position of the hydraulic excavator according to the present embodiment.

The center-of-gravity position of the hydraulic excavator 1 according to the present embodiment will now be described. FIG. 4 is a side view describing the center-of-gravity position of the hydraulic excavator according to the present embodiment. As depicted in FIG. 4, a concentrated mass point model in which a mass is concentrated on a center of gravity of each constituent member is used as a model for obtaining the center-of-gravity position of the hydraulic excavator 1 in the light of simplicity of implementation in the present embodiment. Furthermore, as depicted in FIG. 4, a Z coordinate axis is defined as the vertical direction passing through rotation centers of the swing structure 3 and the track structure 4, an XY plane having an X coordinate axis in a longitudinal direction of the hydraulic excavator 1 (lateral direction in FIG. 4) on the ground and a grounded surface of the crawler belts 45 and a Z coordinate axis in the horizontal direction (perpendicular direction to a paper face in FIG. 4) is defined, and an XYZ coordinate system having an intersecting point between the Z coordinate axis and the XY plane as an origin is defined.

In the XYZ coordinate system of FIG. 4, the center-of-gravity position of the hydraulic excavator 1 is a position at which a boom center of gravity 20G, an arm center of gravity 21G, a bucket center of gravity 22G, a swing-structure center of gravity 3G, and a track-structure center of gravity 4G are combined. The boom center of gravity 20G is a position at which centers of gravity of the boom 20, the boom cylinder 20A, and the IMU sensor (for boom) 20S are combined. Likewise, the arm center of gravity 21G is a position at which centers of gravity of the arm 21, the arm cylinder 21A, and the IMU sensor (for arm) 21S are combined, and the bucket center of gravity 22G is a position at which centers of gravity of the bucket 22, the first link 22B, the second link 22C, the bucket cylinder 22A, and the IMU sensor (for bucket) 21S are combined.

Furthermore, the swing-structure center of gravity 3G is a position at which centers of gravity of the main frame 31, the cabin 32, the operation input device 33, the driving controller 34, the drive device 35, the prime mover 36, the counterweight 37, and the IMU sensor (for swing structure) 30S are combined. Likewise, the track-structure center of gravity 4G is a position at which centers of gravity of the track frame 40, the front idlers 41, the lower rollers (front) 42, the lower rollers (center) 42*b*, the lower rollers (rear) 42*c*, the sprockets 43, the upper rollers 44, and the crawler belts 45 are combined.

It is noted that a mass point setting method is not limited to the above method and a site in which mass points are concentrated may be added or aggregated. In other words, a mass of soils loaded in the bucket 22 may be regarded as a mass of the bucket 22 and a center of gravity of the soils may be combined with that of the bucket center of gravity 22G.

Tipping Line

Figure 5:
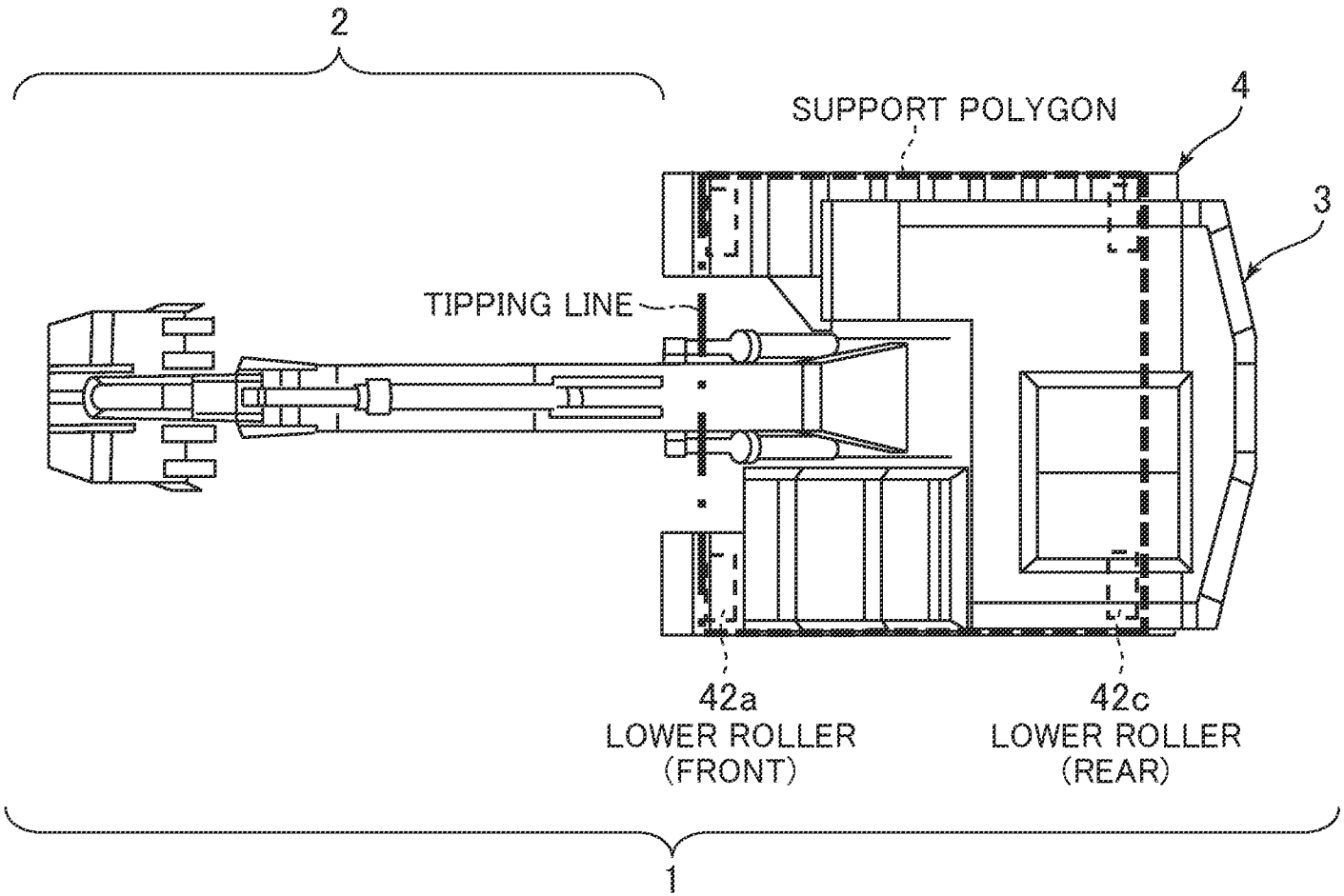
FIG. 5 is a top view depicting a support polygon and tipping lines of the hydraulic excavator according to the present embodiment.

Next, tipping lines of the hydraulic excavator 1 according to the present embodiment will be described. FIG. 5 is a top view depicting a support polygon and tipping lines of the hydraulic excavator according to the present embodiment. The tipping lines are part of the support polygon, and each of the tipping lines is a line connecting points that serve as fulcrums of tipping-over and defined in JIS (Japanese Industrial Standards) A8403-1 (1996).

The support polygon of the hydraulic excavator 1 is a polygon that is connected (convex closed) in such a manner that ground points between the crawler belts 45 and a surface of the ground are not concaved (that is, a polygon having a largest area among those formed by segments connecting the ground points between the crawler belts 45 and the surface of the ground), and indicated by dotted lines (including a dot-and-dash line) in FIG. 5. The tipping lines of the hydraulic excavator 1 are segments each crossed by a straight line that is an extension of a segment connecting a static center-of-gravity position to the dynamic center-of-gravity position on a side of the support polygon in a direction in which the dynamic center-of-gravity position is present from a viewpoint of the static center-of-gravity position. In other words, in a case of the work machine having the crawlers like the hydraulic excavator 1 according to the present embodiment, a line connecting center points of the left and right sprockets is a forward tipping line, a line connecting center points of the left and right idlers is a backward tipping line, and lines indicating outer ends of the left and right track links are left and right tipping lines. In FIG. 5 the forward tipping line is indicated by the dot-and-dash line.

The tipping lines are important elements for determining a threshold to discriminate stability of the hydraulic excavator 1, and the stability of the hydraulic excavator 1 can be evaluated on the basis of a relationship between the ZMP (dynamic center-of-gravity position), to be described later, and the tipping lines. In other words, in a case in which the center-of-gravity position (dynamic center-of-gravity position) of the hydraulic excavator 1 goes beyond the tipping line from a center of the track structure 4 outward (or a reference line of stability evaluation set in advance in the light of the tipping lines), it is possible to evaluate that the hydraulic excavator 1 is in an unstable state in which the machine body possibly tilts or tips over.

In the present embodiment, the front idlers 41 and the sprockets 43 are attached at slightly higher positions than those of the lower rollers 42*a*, 42*b*, and 42*c*; thus, the crawler belts 45 do not contact the ground under the front idlers 41 and the sprockets 43. It is, therefore, defined that the support polygon is formed by connecting points under the lower rollers (front) 42*a* and the lower rollers (rear) 42*c*.

In a case in which a distance between a center of the track structure 4 and the tipping line in the longitudinal direction is generally equal to that in the lateral direction, a circumference at a fixed radius about a line passing through rotation centers of the swing structure 3 and the track structure 4 (for example, on a circumstance inscribed in at least one side of the support polygon) may be assumed as a tipping line in the light of simplicity of implementation, that is, simplicity and effectiveness of calculation.

Calculation of Dynamic Center-of-Gravity Position (First Center-of-Gravity Position Prediction Section 780, Second Center-of-Gravity Position Prediction Section 790, and Third Center-of-Gravity Position Prediction Section 800

Calculation of the dynamic center-of-gravity position by the first center-of-gravity position prediction section 780, the second center-of-gravity position prediction section 790, and the third center-of-gravity position prediction section 800 will be described.

The dynamic center-of-gravity position is a center-of-gravity position in the light of an influence of an inertial force produced when the front work implement 2 and the swing structure 3 operate, as opposed to the static center-of-gravity position of the hydraulic excavator 1. The dynamic center-of-gravity position of the hydraulic excavator 1 according to the present embodiment is obtained by a ZMP equation indicated by the following (Equation 1).

[Math. 1]

$$\Sigma_i m_i(r_i - r_{ZMP}) \times r_i'' - \Sigma_j M_j - \Sigma_k (S_k - r_{ZMP}) \times F_k = 0 \quad \text{(Equation 1)}$$

In (Equation 1), rZMP denotes a ZMP position vector, mi denotes a mass of an i-th mass point, ri denotes a position vector of the i-th mass point, ri" denotes an acceleration vector (including a gravitational acceleration) applied to the i-th mass point, Mj denotes a j-th external force moment, Sk denotes a k-th external force working point position vector, and Fk denotes a k-th external force vector. In addition, each vector is a three-dimensional vector configured with an X component, a Y component, and a Z component.

Since it is assumed in the present embodiment that an external force moment does not affect the calculation of the dynamic center-of-gravity position, parts related to the external force in (Equation 1), that is, terms of the i-th external force moment, the k-th external force working point position vector, and the k-th external force vector can be regarded as 0 (zero). Thus, it is possible to obtain the dynamic center-of-gravity position of the hydraulic excavator 1 using (Equation 1) by giving masses of mass points, position vectors, and acceleration vectors related to configurations of the hydraulic excavator 1.

Estimation of Center-of-Gravity Acceleration (Acceleration Vector)

Estimation of the acceleration vector in (Equation 1) will be described.

Figure 6:
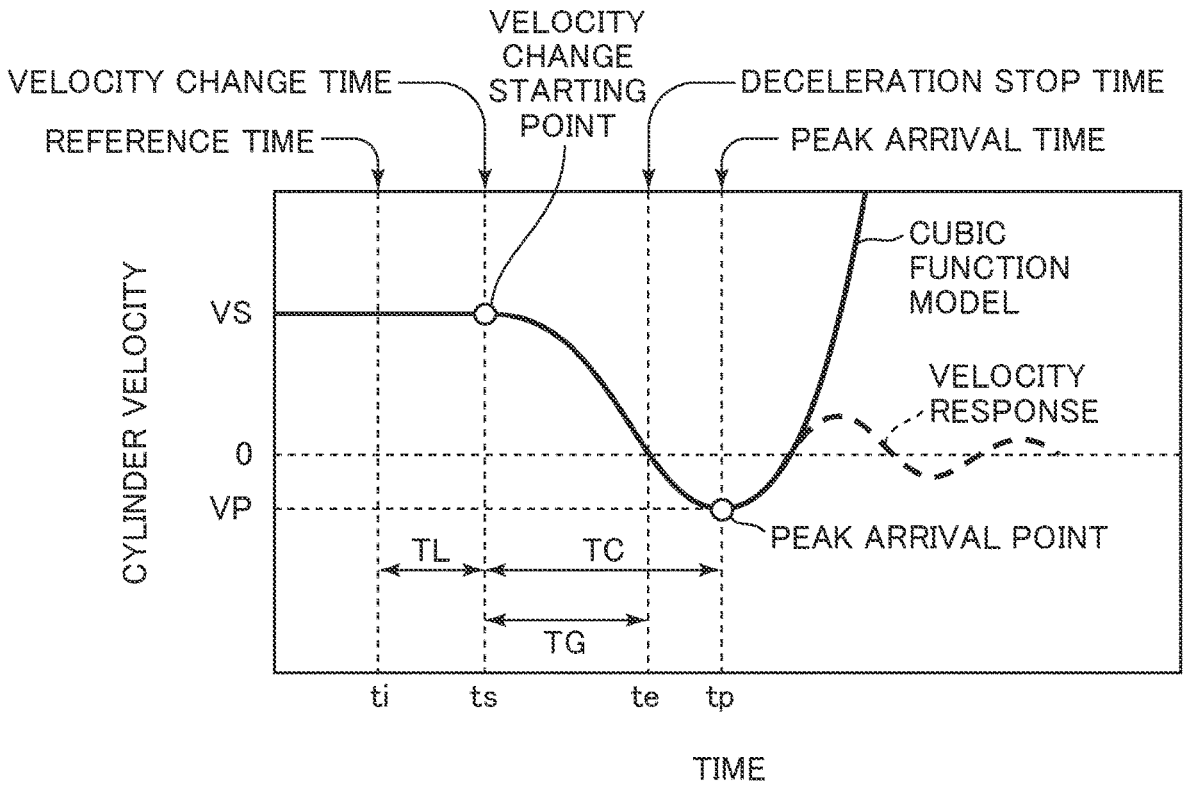
FIG. 6 is a diagram depicting an example of transition of a cylinder velocity.

In a case of returning the levers of the operation input device 33 to the neutral positions to stop the front work implement 2, an acceleration at the center-of-gravity position of each member of the front work implement 2 can be estimated using a cubic function model depicted in FIG. 6.

In the case of returning the operation levers 33*a* of the operation input device 33 to the neutral positions to stop the boom cylinder 20A, the arm cylinder 21A, and the bucket cylinder 22A, a change in the velocity of each of the cylinders 20A, 21A, and 22A over time is that depicted in FIG. 6. As indicated by a graph depicted in FIG. 6, if it is defined that time ti at which the operation levers 33*a* are returned to the neutral positions is reference time, a maximum acceleration of each cylinder that is decelerating occurs midway between velocity change time ts and peak arrival time tp. Owing to this, if velocities VS and VP and times TL, Tc, and TG in FIG. 6 are given, it is possible to compute the maximum acceleration of each of the cylinders 20A, 21A, and 22A that are decelerating. The velocities VS and VP and the times TL, Tc, and TG can be measured in advance by experiments having different degrees of a stop operation. Furthermore, it is confirmed by experiments that factors related to the cubic function model have substantially the same value regardless of the operating velocities of the cylinders 20A, 21A, and 22A. Therefore, determining the factors related to the cubic function model by experiments or the like in advance makes it possible to compute a peak acceleration at a time of stopping each of the cylinders 20A, 21A, and 22A for an arbitrary cylinder velocity (operating velocity). As described above, mechanical connection between the cylinders 20A, 21A, and 22A and the driven members 20, 21, and 22 of the front work implement 2 is bonded as depicted in FIG. 1; thus, it is easy to convert the accelerations of the cylinders 20A, 21A, and 22A into accelerations of the driven members 20, 21, and 22 at center-of-gravity positions by link mechanism computing.

Velocity Limiting Control and Slow Deceleration Control (Target Operating Velocity Correction Section 720)

The velocity limiting control and the slow deceleration control by the target operating velocity correction section 720 will be described.

Slow Deceleration Control

Figure 7:
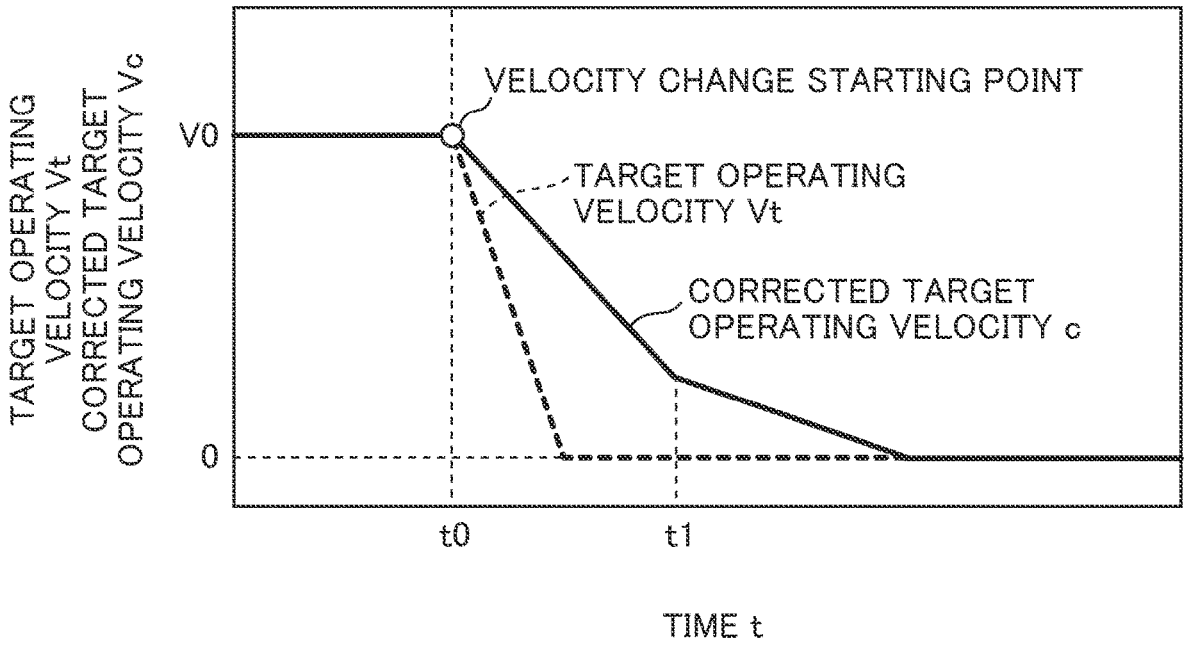
FIG. 7 is an explanatory diagram about slow deceleration control over a front work implement.

FIG. 7 is an explanatory diagram about the slow deceleration control over the front work implement.

The slow deceleration control is control to correct the target operating velocity Vt to the corrected target operating velocity Vc in such a manner that the front work implement 2 slowly decelerates. In the slow deceleration control, as depicted in FIG. 7, in a case in which the target operating velocity Vt suddenly decreases, the target operating velocity Vt is corrected to the corrected target operating velocity Vc in such a manner that the corrected target operating velocity decelerates in accordance with a preset deceleration rate from time t0 at which reduction of the target operating velocity Vt starts. While a case of correcting the target operating velocity vt by providing two deceleration rates so that the deceleration rate is changed over at the time t1 is exemplarily described in the present embodiment, setting of the deceleration rate is not limited to this case. For example, the target operating velocity Vt may be corrected at the fixed deceleration rate at and after time t0 or a plurality of or three or more deceleration rates may be set. Furthermore, it is not always necessary to limit the number of deceleration rate patterns to one. The target operating velocity correction section 720 may be configured to prepare a plurality of deceleration rate patterns and to use the patterns properly as needed.

Velocity Limiting Control

Figure 8:
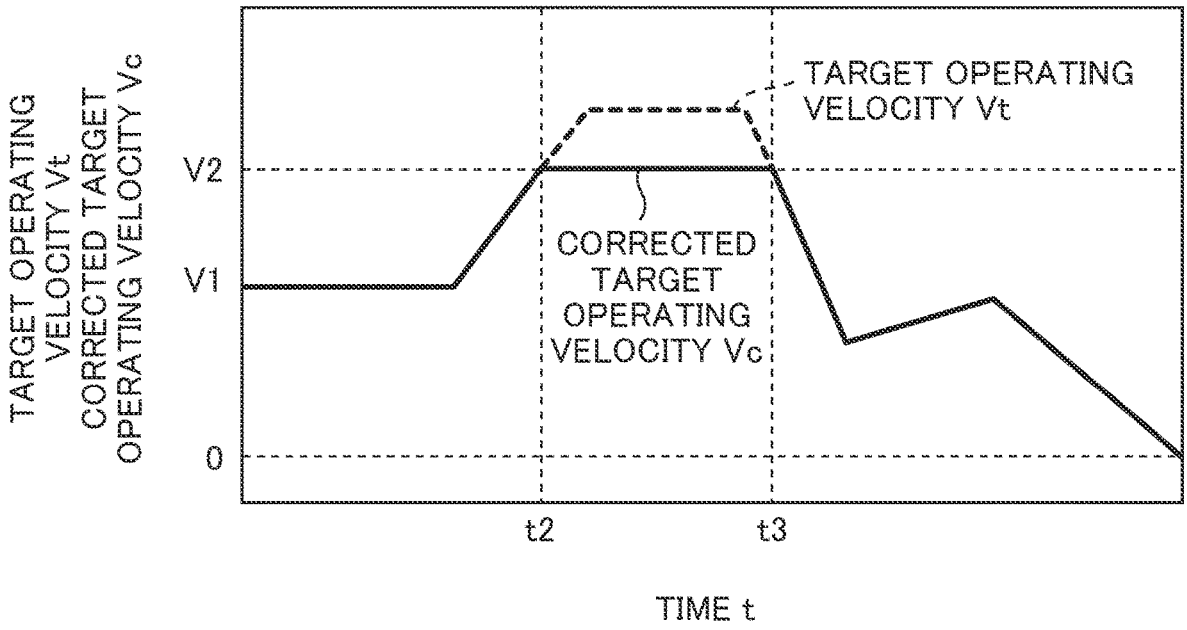
FIG. 8 is an explanatory diagram about a velocity limiting control over the front work implement.

FIG. 8 is an explanatory diagram about the velocity limiting control over the front work implement.

The velocity limiting control is control to correct the target operating velocity Vt to the corrected target operating velocity Vc in such a manner that each operating velocity of the front work implement 2 is limited to be equal to or lower than a predetermined value. In the velocity limiting control, as depicted in FIG. 8, in a case in which the target operating velocity Vt becomes higher than a preset limiting velocity V2, the target operating velocity Vt is corrected to the corrected target operating velocity Vc in such a manner that a maximum value of the target operating velocity Vt is limited to be equal to or lower than the limiting velocity V2. While a case of providing one limiting velocity is exemplarily described in the present embodiment, setting of the limiting velocity is not limited to this case. The target operating velocity correction section 720 may be configured to provide a plurality of limiting velocities and to change over the limiting velocities as needed or to change the limiting velocities depending on a magnitude of ZMP.

Estimation of Velocity (Operating Velocity Estimation Section 760

Estimation of the estimated operating velocity Ve by the operating velocity estimation section 760 will be described.

The operating velocity estimation section 760 estimates the estimated operating velocity Ve of each of the boom cylinder 20A, the arm cylinder 21A, and the bucket cylinder 22A from the target operating velocity Vt and the actual operating velocity Vr. For example, the operating velocity estimation section 760 can estimate a cylinder velocity V(t+TL) TL seconds of time after certain time t using a velocity estimation model indicated by the following (Equation 2).

[Math. 2]

$$V(t+T_L)=\frac{O(t)\times V(t)}{O(T_L)} \quad \text{(Equation 2)}$$

In (Equation 2), O(TL) indicates a lever operation amount the TL seconds before, O(t) indicates a current lever operation amount, and V(t) denotes a current cylinder velocity.

Velocity Estimation Model Establishment/non-establishment Determination (Velocity Estimation Model Establishment/non-establishment Determination Section 770

A velocity estimation model establishment/non-establishment determination by the velocity estimation model establishment/non-establishment determination section 770 will be described.

For example, in a case in which there is no sudden change in an external force or a change in the operation amount (sudden operation) of the operation lever 33*a* within minute time, it is considered that the velocity estimation model represented by (Equation 2) is established. However, in a case of the sudden change in the external force or the sudden operation, it is considered that the velocity estimation model represented by (Equation 2) is not established. Furthermore, since it is difficult to predict the sudden change in the external force or the sudden operation, it is impossible to create a velocity estimation model adapted to the sudden change in the external force or the sudden operation at least for the work machine like the hydraulic excavator 1 in the present embodiment.

On the other hand, a magnitude of an influence of the sudden change in the external force or the sudden operation on the hydraulic excavator 1 can be estimated by observing the target operating velocity Vt and the actual operating velocity Vr. For example, in the case of the sudden change in the external force, then a load is imposed on the hydraulic system and the operation of the front work implement 2 is limited; thus, the actual operating velocity Vr decreases and a value of the actual operating velocity Vr becomes smaller than that of the target operating velocity Vt. Furthermore, in the case of the sudden operation, then it is impossible for the actual operating velocity Vr to promptly follow up the target operating velocity Vt because of the high inertia of the front work implement 2, and a difference is generated between the target operating velocity Vt and the actual operating velocity Vr. In other words, it is possible to observe the influence of the sudden change in the external force or the sudden operation as the difference between the target operating velocity Vt and the actual operating velocity Vr.

Hence, the velocity estimation model establishment/non-establishment determination section 770 determines whether the velocity estimation model is established on the basis of the velocity difference between the target operating velocity Vt and the actual operating velocity Vr. Specifically, in a case in which the difference between the target operating velocity Vt and the actual operating velocity Vr is smaller than a predetermined value, the velocity estimation model establishment/non-establishment determination section 770 determines that the velocity estimation model indicated by (Equation 2) is established, and outputs the velocity estimation model establishment/non-establishment information (established) indicating that the velocity estimation model is established. In addition, in a case in which the difference between the target operating velocity Vt and the actual operating velocity Vr is larger than the predetermined value, the velocity estimation model establishment/non-establishment determination section 770 determines that the velocity estimation model indicated by (Equation 2) is not established due to the sudden change in the external force or the sudden operation, and outputs the velocity estimation model establishment/non-establishment information (not established) indicating that the velocity estimation model is not established.

Determination of Control Intervention (Control Intervention Determination Section 810

Determination of the control intervention by the control intervention determination section 810 will be described.

The control intervention determination section 810 uses the ZMP (dynamic center-of-gravity position) computed by the first center-of-gravity position prediction section 780 on the basis of the estimated operating velocity Ve of each of the boom cylinder 20A, the arm cylinder 21A, and the bucket cylinder 22A in a case in which the velocity estimation model indicated by (Equation 2) is established, that is, in a case in which a determination result from the velocity estimation model establishment/non-establishment determination section 770 is the velocity estimation model establishment/non-establishment information (established), determines to perform the control intervention of the velocity limiting control and the slow deceleration control and outputs the intervention presence/absence information (velocity limiting control and slow deceleration control) in a case in which the ZMP (dynamic center-of-gravity position) is larger than a predetermined value, and determines not to perform the control intervention and outputs the intervention presence/absence information indicating no control intervention in a case in which the ZMP (dynamic center-of-gravity position) is smaller than the predetermined value.

Furthermore, the control intervention determination section 810 determines the control intervention using velocity information, such as the target operating velocity Vt or the actual operating velocity Vr, other than the estimated operating velocity Ve and using the ZMP (dynamic center-of-gravity position) computed by the second center-of-gravity position prediction section 790 or the third center-of-gravity position prediction section 800 in a case in which the determination result from the velocity estimation model establishment/non-establishment determination section 770 is the velocity estimation model establishment/non-establishment information (not established).

In the velocity limiting control, it is necessary to correct the target operating velocity Vt in advance to prevent the corrected target operating velocity Vc from being excessive from a moment of starting operating the operation levers 33*a*, that is, in such a manner that the corrected target operating velocity Vc is low before the front work implement 2 operates. Since the front work implement 2 operates in response to the target operating velocity Vt based on the operation amounts of the operation levers 33*a*, performing the intervention determination using the ZMP computed from the target operating velocity Vt by the third center-of-gravity position prediction section 800 enables the target operating velocity correction section 720 to correct the target operating velocity Vt in advance by exercising the velocity limiting control.

In addition, in the slow deceleration control, it is necessary to correct the target operating velocity Vt from timing at which the operation levers 33*a* are operated for deceleration. In the hydraulic system such as the hydraulic excavator 1, each operating velocity of the front work implement 2 becomes lower than the target operating velocity Vt in a case of an input operation like an impulse due to response characteristics. Owing to this, in a case in which it is necessary to exercise the slow deceleration control over the front work implement 2, a value of the actual operating velocity Vr is sufficiently large. Hence, performing the intervention determination using the ZMP computed from the actual operating velocity Vr by the second center-of-gravity position prediction section 790 enables the target operating velocity correction section 720 to correct the target operating velocity Vt by exercising the slow deceleration control.

Figure 9:
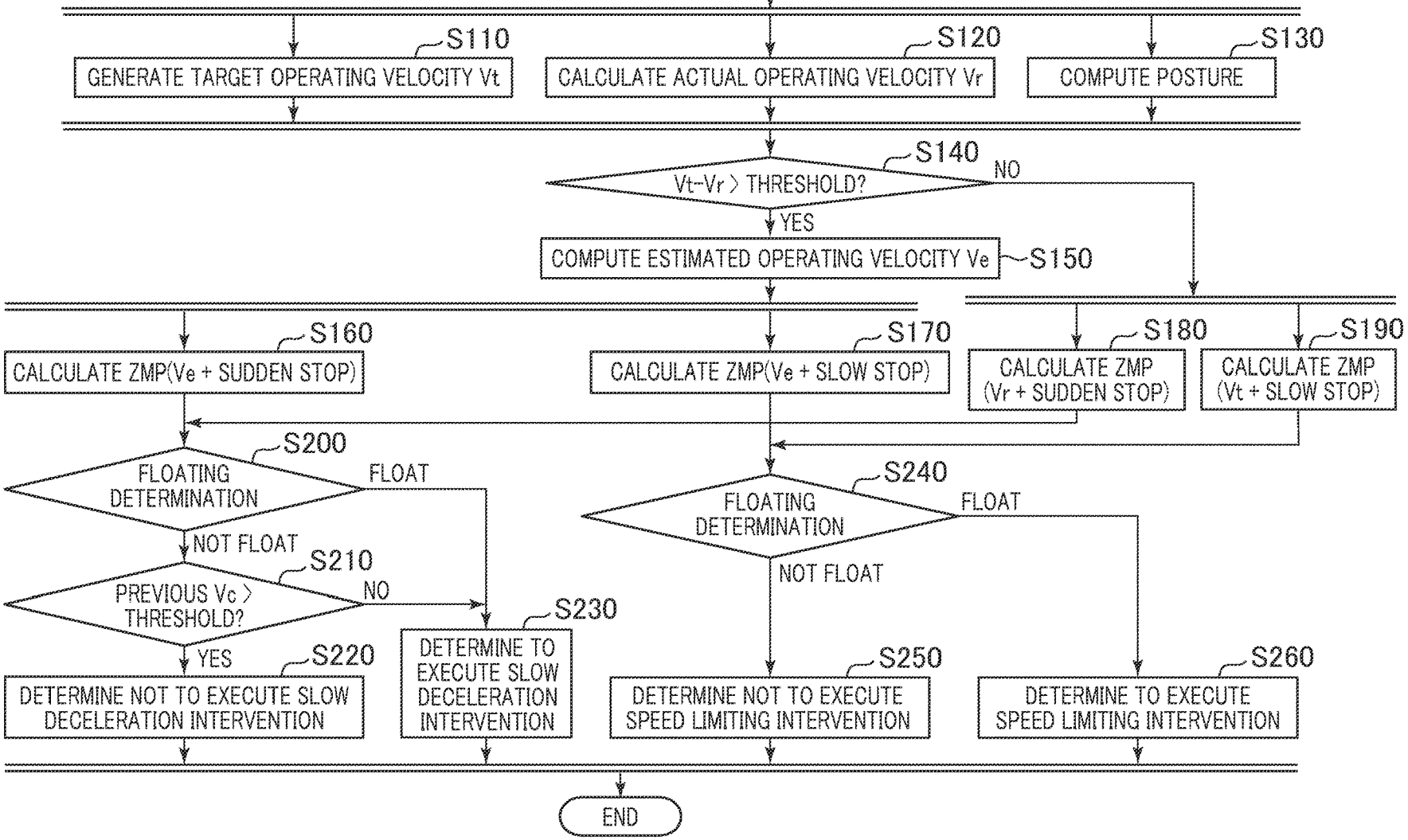
FIG. 9 is a flowchart depicting a process related to determination of control intervention.

FIG. 9 is a flowchart depicting a process related to determination of the control intervention.

In FIG. 9, the target operating velocity generation section 710 generates first the target operating velocity Vt on the basis of the operation signal from the operation input amount sensor 33*b* (Step S110), and the operating velocity detection section 740 and the posture detection section 750 generate the actual operating velocity Vr and the posture information on the basis of the detection result of any of the IMU sensors 20S, 21S, 22S, and 30S (Steps S120, S130).

Next, the control intervention determination section 810 determines whether the difference between the target operating velocity Vt and the actual operating velocity Vr is larger than a preset threshold (Step S140), the operating velocity estimation section 760 computes the estimated operating velocity Ve in a case in which a determination result is YES (Step S150), and the first center-of-gravity position prediction section 780 calculates the ZMP using the estimated operating velocity Ve in a case in which the front work implement is suddenly stopped (Step S160), and calculates the ZMP using the estimated operating velocity Ve in a case in which the front work implement is slowly stopped (Step S170).

Subsequently, the control intervention determination section 810 performs a floating determination based on the ZMP calculated in Step S160 (Step S200), and determines whether the corrected target operating velocity Vc at a time of a previous process is higher than the preset threshold (Step S210) in a case in which the hydraulic excavator 1 does not float. The floating determination is performed on the basis of a position relationship between the reference line set on the basis of the tipping lines and the ZMP. For example, the control intervention determination section 810 compares the reference line set inward of any of the tipping lines by a predetermined distance with the ZMP, determines that the hydraulic excavator 1 does not float (there is no probability of floating) in a case in which the ZMP is closer to the static center-of-gravity position than the reference line, and determines that the hydraulic excavator 1 floats (there is a probability of floating) in a case in which the ZMP is present on the reference line or outward of the reference line (farther than the static center-of-gravity position). While various methods of setting the reference line for the floating determination are conceivable, the reference line may be set, for example, on the tipping line.

In a case in which it is determined that the hydraulic excavator 1 does not float in Step S200 and in which a determination result of Step S210 is YES, the control intervention determination section 810 determines not to perform the control intervention of the slow deceleration control (Step S220). Furthermore, in a case in which it is determined the hydraulic excavator 1 floats in Step S200 or in which the determination result of Step S210 is NO, the control intervention determination section 810 determines to perform the control intervention of the slow deceleration control (Step S230).

Likewise, the control intervention determination section 810 performs the floating determination based on the ZMP calculated in Step S170 (Step S240), determines not to perform the control intervention of the velocity limiting control (Step S250) in the case of determining that the hydraulic excavator 1 does not float, and determines to perform the control intervention of the velocity limiting control (Step S260) in the case of determining that the hydraulic excavator 1 floats.

When it is determined whether to perform the control intervention with respect to the slow deceleration control or the velocity limiting control in Step S220, S230, S250, or S260, the process is ended.

Moreover, in a case in which the determination result of Step S140 is NO, then the second center-of-gravity position prediction section 790 calculates the ZMP using the actual operating velocity Vr in the case in which the front work implement is suddenly stopped (Step S180), and the third center-of-gravity position prediction section 800 calculates the ZMP using the target operating velocity Vt in the case in which the front work implement is slowly stopped (Step S190).

Subsequently, the control intervention determination section 810 performs the floating determination based on the ZMP calculated in Step S180 (Step S200), and determines whether the corrected target operating velocity Vc at the time of the previous process is higher than the preset threshold (Step S210) in the case in which the hydraulic excavator 1 does not float. In the case in which the hydraulic excavator 1 does not float in Step S200 and in which the determination result of Step S210 is YES, the control intervention determination section 810 determines not to perform the control intervention of the slow deceleration control (Step S220). Furthermore, in the case in which it is determined that the hydraulic excavator 1 floats in Step S200 or in which the determination result of Step S210 is NO, the control intervention determination section 810 determines to perform the control intervention of the slow deceleration control (Step S230).

Likewise, the control intervention determination section 810 performs the floating determination based on the ZMP calculated in Step S190 (Step S240), determines not to perform the control intervention of the velocity limiting control (Step S250) in the case of determining that the hydraulic excavator 1 does not float, and determines to perform the control intervention of the velocity limiting control (Step S260) in the case of determining that the hydraulic excavator 1 floats.

When it is determined whether to perform the control intervention with respect to the slow deceleration control or the velocity limiting control in Step S220, S230, S250, or S260, the process is ended.

Determination of Control Command Values (Target Operating Velocity Correction Section 720 and Drive Command Section 730

A corrected target operating velocity calculation process by the target operating velocity correction section 720 and a controlling command value determination process by the drive command section 730 will be described.

Figure 10:
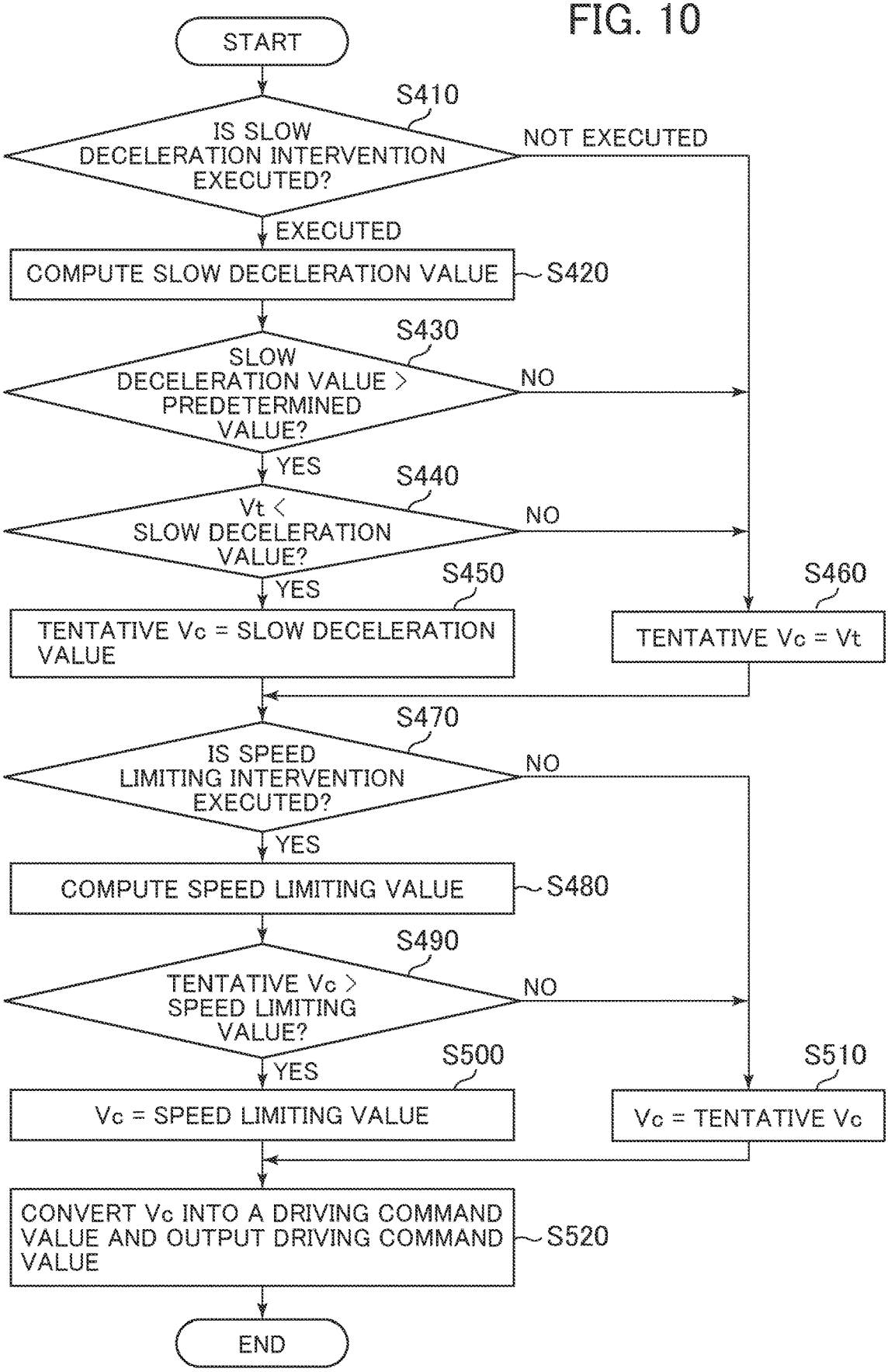
FIG. 10 is a flowchart depicting a corrected target operating velocity calculation process and a process related to determination of a control command value.

FIG. 10 is a flowchart depicting the corrected target operating velocity calculation process and the process related to determination of the control command value.

In FIG. 10, the target operating velocity correction section 720 determines whether the control intervention information (slow deceleration control) indicating that it is determined to perform the control intervention of the slow deceleration control has been input (Step S410). In a case of the control intervention of the slow deceleration control, the target operating velocity correction section 720 calculates the target operating velocity (slow deceleration value) for a case of exercising the slow deceleration control over the target operating velocity Vt (Step S420). Subsequently, the target operating velocity correction section 720 determines whether the slow deceleration value calculated in Step S420 is larger than a preset predetermined value (S430), then determines whether the slow deceleration value is larger than the target operating velocity Vt (Step S440) in a case in which a determination result of Step S430 is YES, and sets the slow deceleration value as a tentative corrected target operating velocity Vc (Step S450) in a case in which a determination result of Step S440 is YES. Furthermore, in a case in which it is determined not to execute the control intervention of the slow deceleration control in Step S410 or the determination result of at least one of Steps S430 and S440 is NO, the target operating velocity correction section 720 sets the target operating velocity Vt as the tentative corrected target operating velocity Vc (S460).

Subsequently, upon completion of the process in Step S450 or S460, the target operating velocity correction section 720 determines whether the control intervention information (velocity limiting control) indicating that it is determined to perform the control intervention of the velocity limiting control has been input (Step S470). In a case of the control intervention of the velocity limiting control, the target operating velocity correction section 720 calculates the target operating velocity (velocity limiting value) for a case of exercising the velocity limiting control over the target operating velocity Vt (Step S480). Subsequently, the target operating velocity correction section 720 determines whether the velocity limiting value calculated in Step S480 is smaller than the tentative corrected target operating velocity Vc (S490). In a case in which a determination result is YES, the target operating velocity correction section 720 sets the velocity limiting value as the corrected target operating velocity Vc and outputs the corrected target operating velocity c to the drive command section 730 (S500). Furthermore, in a case in which it is determined not to perform the control intervention of the velocity limiting control in Step S470 or in which a determination result of Step S490 is NO, the target operating velocity correction section 720 sets the tentative corrected target operating velocity Vc as the corrected target operating velocity Vc and outputs the corrected target operating velocity c to the drive command section 730 (Step S510).

Subsequently, upon completion of the process in Step S500 or S510, the drive command section 730 converts the corrected target operating velocity Vc from the target operating velocity correction section 720 into the current (control command value) for driving the drive device 35 and outputs the current to the solenoid control valve 35*a* (Step S520), and the process is ended.

Functions and advantages of the present embodiment configured as described so far will be described.

There is proposed the technique for estimating, in real time, dynamic stability related to floating of the work machine using the ZMP calculated using the velocity estimation model, and limiting the operating velocities of the front work implement or slowly decelerating the front work implement in the case of estimating that there is a high probability that the work machine tilts from this dynamic stability, thereby suppressing the work machine from tilting. Nevertheless, in the case of performing the work, such as the bumping work, involving the abrupt change in disturbance and the change in the lever operation amount within the minute time, the velocity estimation model is not established. In other words, if the velocity estimation model is not established, it is impossible to obtain an accurate ZMP. Owing to this, the control intervention such as the slow deceleration of or velocity limiting on the front work implement is not performed properly, and an increase in the braking distance of the front work implement, floating of the machine body due to lack of the velocity limiting, and the like are predicted. As a result, the front work implement operates differently from driver's prediction, possibly resulting in great reductions in workability and operability and a deterioration in the ride quality.

In the present embodiment, by contrast, the driving controller 34 is configured to determine whether the velocity estimation model is established on the basis of the result of comparing the actual operating velocity Vr with the target operating velocity Vt of each of the actuators 20A, 21A, and 22A; in a case of determining that the velocity estimation model is established, to predict the dynamic center-of-gravity position of the hydraulic excavator 1 in the case in which each of the actuators 20A, 21A, and 22A is suddenly stopped from the driven state from the estimated operating velocity Ve; in the case of determining that the velocity estimation model is established, to determine whether to execute the control intervention using the predicted dynamic center-of-gravity position; in the case of determining that the velocity estimation model is not established, to determine whether to execute the control intervention using the predicted dynamic center-of-gravity position predicted from the actual operating velocity Vr as an alternative to the dynamic center-of-gravity position predicted from the estimated operating velocity Ve; and in the case in which it is determined to execute the control intervention, to correct the target operating velocity Vt in such a manner that each of the actuators 20A, 21A, and 22A slowly decelerates by limiting the deceleration rate of the target operating velocity Vt. Therefore, even in the case of work involving a sudden change in disturbance or a change in the lever operation amount within minute time, it is appropriately carry out operating velocity limiting on the front work implement and slow deceleration of the front work implement, and it is possible to suppress reductions in workability and operability and a deterioration in a ride quality.

In other words, in the present embodiment, even in a case of performing the work, such as the bumping, in which the machine body does not float, but which involves the abrupt change in disturbance or the change in the lever operation amount within minute time and for which the velocity estimation model is not established, the floating determination is performed using the appropriate ZMP and the stability of the hydraulic excavator 1 is determined; thus, It is possible to suppress unnecessary operating velocity limiting on the front work implement 2 and unnecessary slow deceleration of the front work implement 2, and to suppress reductions in workability and operability, a deterioration in a ride quality, and the like. Furthermore, even in a case of performing work for which the velocity estimation model is established, it is possible to appropriately carry out the operating velocity limiting on the front work implement and the slow deceleration of the front work implement; thus, It is possible to suppress the reductions in workability and operability, the deterioration in the ride quality, and the like.

(1) In the embodiment described above, there is provided the work machine (for example, hydraulic excavator 1) including: the track structure 4; the swing structure 3 swingably attached onto the track structure; the front work implement 2 that is configured by coupling the plurality of driven members (for example, boom 20, arm 21, and bucket 22) in such a manner as to be rotatable in a perpendicular direction and that is supported by the swing structure in such a manner as to be rotatable in the perpendicular direction; the plurality of actuators (for example, boom cylinder 20A, arm cylinder 21A, and bucket cylinder 22A) that drive the plurality of driven members of the front work implement, respectively; the plurality of motion information sensors (for example, IMU sensors 20S, 21S, and 22S) that detect information regarding motions of the plurality of driven members that configure the swing structure and the front work implement during operations of the plurality of driven members; and the controller (for example, driving controlling controller 34*a*) that controls the plurality of actuators to be driven, the controller including: the target operating velocity generation section 710 that generates the target operating velocity Vt of each of the plurality of actuators on the basis of the operation signal generated in response to the operation amount of the operation lever operating the actuator; the operating velocity detection section 740 that detects the actual operating velocity Vr of each of the plurality of actuators on the basis of each of the information regarding the motions of the motions of the plurality of driven members detected by the motion information sensors; the operating velocity estimation section 760 that estimates the operating velocity (for example, estimated operating velocity Ve) of each of the plurality of actuators on the basis of a velocity estimation model set in advance from the target operating velocity and the actual operating velocity; the first center-of-gravity position prediction section 780 that predicts the dynamic center-of-gravity position of the work machine in the case in which each of the plurality of actuators is suddenly stopped from the driven state, using the operating velocity of each of the plurality of actuators estimated by the operating velocity estimation section; the control intervention determination section 810 that determines whether to execute control intervention to correct the target operating velocity on the basis of the dynamic center-of-gravity position; the target operating velocity correction section 720 that corrects the target operating velocity generated by the target operating velocity generation section in such a manner as to suppress floating of the work machine; the drive command section 730 that controls each of the plurality of actuators to be driven on the basis of the target operating velocity corrected by the target operating velocity correction section; the velocity estimation model establishment/non-establishment determination section 770 that determines whether the velocity estimation model is established on the basis of the result of comparing the actual operating velocity detected by the operating velocity detection section with the target operating velocity generated by the target operating velocity generation section; and the second center-of-gravity position prediction section 790 that predicts the dynamic center-of-gravity position of the work machine in the case in which each of the plurality of actuators is suddenly stopped from the driven state, using the actual operating velocity of each of the plurality of actuators detected by the operating velocity detection section, the control intervention determination section determining whether to execute the control intervention using the dynamic center-of-gravity position predicted by the second center-of-gravity position prediction section as an alternative to the dynamic center-of-gravity position predicted by the first center-of-gravity position prediction section in the case in which the velocity estimation model establishment/non-establishment determination section determining that the velocity estimation model is not established, and the target operating velocity correction section corrects the target operating velocity in such a manner that each of the plurality of actuators slowly decelerates by limiting the deceleration rate of the target operating velocity in the case in which the control intervention determination section determines to execute the control intervention.

It is thereby possible to appropriately carry out the operating velocity limiting on the front work implement 2 and the slow deceleration of the front work implement 2 and to suppress the reductions in workability and operability, the deterioration in the ride quality, and the like even in the case of work involving the abrupt change in disturbance or the change in the lever operation amount within minute time.

(2) Furthermore, in the embodiment, in the work machine (for example, hydraulic excavator 1) set forth in (1), the controller (for example, driving controlling controller 34*a*) further includes the third center-of-gravity position prediction section 800 that predicts the dynamic center-of-gravity position of the work machine in the case in which each of the plurality of actuators (for example, boom cylinder 20A, arm cylinder 21A, bucket cylinder 22A) is suddenly stopped from the driven state, from the target operating velocity Vt generated by the target operating velocity generation section 710, the control intervention determination section 810 determines whether to perform the control intervention using the dynamic center-of-gravity position predicted by the third center-of-gravity position prediction section 800 as an alternative to the dynamic center-of-gravity position predicted by the first center-of-gravity position prediction section 780 in the case in which the velocity estimation model establishment/non-establishment determination section 770 determines that the velocity estimation model is not established, and the target operating velocity correction section 720 corrects the target operating velocity in such a manner as to limit the maximum value of the target operating velocity in the case in which the control intervention determination section determines to execute the control intervention.

(3) Moreover, in the embodiment, in the work machine (for example, hydraulic excavator 1) set forth in (1), the control intervention determination section 810 executes the floating determination to determine whether the work machine possibly floats using the dynamic center-of-gravity position predicted by the second center-of-gravity position prediction section 790 in the case in which the velocity estimation model establishment/non-establishment determination section 770 determines that the velocity estimation model is not established, and that determines to execute the control intervention in the case of determining that the work machine possibly floats in the floating determination, the target operating velocity correction section 720 corrects the target operating velocity in such a manner that each of the plurality of actuators (for example, boom cylinder 20A, arm cylinder 21A, bucket cylinder 22A) slowly decelerates by limiting the deceleration rate of the target operating velocity in the case in which the control intervention determination section determines to execute the control intervention.

(4) Further, in the embodiment, in the work machine (for example, hydraulic excavator 1) set forth in (2), the control intervention determination section 810 executes a floating determination to determine whether the work machine possibly floats using the dynamic center-of-gravity position predicted by the third center-of-gravity position prediction section 800 in the case in which the velocity estimation model establishment/non-establishment determination section 770 determines that the velocity estimation model is not established, and that determines to execute the control intervention in the case of determining that the work machine possibly floats in the floating determination, and the target operating velocity correction section 720 corrects the target operating velocity in such a manner as to limit the maximum value of the target operating velocity in the case in which the control intervention determination section determines to execute the control intervention.

Note

It is noted that the present invention is not limited to the above embodiment but encompasses various modifications and combinations without departing from the spirit of the invention. Moreover, the present invention is not limited to the work machine that includes all the configurations described in the embodiment but encompasses those from which a part of the configurations are deleted. Furthermore, the configurations, the functions, and the like described above may be realized by, for example, designing a part or all thereof with integrated circuits. Moreover, the configurations, functions, and the like described above may be realized by software by causing a processor to interpret and execute programs that realize the respective functions.

DESCRIPTION OF REFERENCE CHARACTERS

1: Hydraulic excavator
2: Front work implement
3: Swing structure
3A: Swing hydraulic motor
3A: Actuator
3G: Swing-structure center of gravity
4: Track structure
4G: Track-structure center of gravity
20: Boom
20A: Boom cylinder
20G: Boom center of gravity
20S: IMU sensor (for boom)
21: Arm
21A: Arm cylinder
21G: Arm center of gravity
21S: IMU sensor (for arm)
22: Bucket
22A: Bucket cylinder
22B: First link
22C: Second link
22G: Bucket center of gravity
22S: IMU sensor (for bucket)
30S: IMU sensor (for swing structure)
31: Main frame
32: Cabin
33: Operation input device
33*a*: Operation lever
33*b*: Operation input amount sensor
34: Driving controller
34*a*: Driving controlling controller
35: Drive device
35*a*: Solenoid control valve
35*b*: Directional control valve
36: Prime mover
36*a*: Hydraulic pump
36*b*: Engine
37: Counterweight
40: Track frame
41: Front idler
42*a*: Lower roller (front)
42*b*: Lower roller (center)
42*c*: Lower roller (rear)
43: Sprocket
43A: track hydraulic motor
44: Upper roller
45: Crawler belt
710: Target operating velocity generation section
720: Target operating velocity correction section
730: Drive command section
740: Operating velocity detection section
750: Posture detection section
760: Operating velocity estimation section
770: Velocity estimation model establishment/non-establishment determination section
780: First center-of-gravity position prediction section
790: Second center-of-gravity position prediction section
800: Third center-of-gravity position prediction section
810: Control intervention determination section

The invention claimed is:

1. A work machine comprising:

a track structure;

a swing structure swingably attached onto the track structure;

a multijoint front work implement that is configured by coupling a plurality of driven members in such a manner as to be rotatable in a perpendicular direction and that is supported by the swing structure in such a manner as to be rotatable in the perpendicular direction;

a plurality of actuators that drive the plurality of driven members of the front work implement, respectively;

a plurality of motion information sensors that detect information regarding motions of the plurality of driven members that configure the swing structure and the front work implement during operations of the plurality of driven members; and a controller that controls the plurality of actuators to be driven, wherein the controller includes a target operating velocity generation section that generates a target operating velocity of each of the plurality of actuators on a basis of an operation signal generated in response to an operation amount of an operation lever operating the actuator, an operating velocity detection section that detects an actual operating velocity of each of the plurality of actuators on a basis of each of the information regarding the motions of the plurality of driven members detected by the motion information sensors, an operating velocity estimation section that estimates an operating velocity of each of the plurality of actuators on a basis of a velocity estimation model set in advance from the target operating velocity and the actual operating velocity, a first center-of-gravity position prediction section that predicts a dynamic center-of-gravity position of the work machine in a case in which each of the plurality of actuators is suddenly stopped from a driven state, using the operating velocity of each of the plurality of actuators estimated by the operating velocity estimation section, a control intervention determination section that determines whether to execute control intervention to correct the target operating velocity on a basis of the dynamic center-of-gravity position, a target operating velocity correction section that corrects the target operating velocity generated by the target operating velocity generation section in such a manner as to suppress floating of the work machine, a drive command section that controls each of the plurality of actuators to be driven on a basis of the target operating velocity corrected by the target operating velocity correction section, a velocity estimation model establishment/non-establishment determination section that determines whether the velocity estimation model is established on a basis of a result of comparing the actual operating velocity detected by the operating velocity detection section with the target operating velocity generated by the target operating velocity generation section, and a second center-of-gravity position prediction section that predicts a dynamic center-of-gravity position of the work machine in a case in which each of the plurality of actuators is suddenly stopped from the driven state, using the actual operating velocity of each of the plurality of actuators detected by the operating velocity detection section, the control intervention determination section determines whether to execute the control intervention using the dynamic center-of-gravity position predicted by the second center-of-gravity position prediction section as an alternative to the dynamic center-of-gravity position predicted by the first center-of-gravity position prediction section in a case in which the velocity estimation model establishment/non-establishment determination section determines that the velocity estimation model is not established, and the target operating velocity correction section corrects the target operating velocity in such a manner that each of the plurality of actuators slowly decelerates by limiting a deceleration rate of the target operating velocity in a case in which the control intervention determination section determines to execute the control intervention.

2. The work machine according to claim 1, wherein the controller further includes a third center-of-gravity position prediction section that predicts a dynamic center-of-gravity position of the work machine in a case in which each of the plurality of actuators is suddenly stopped from the driven state, from the target operating velocity generated by the target operating velocity generation section, the control intervention determination section determines whether to perform the control intervention using the dynamic center-of-gravity position predicted by the third center-of-gravity position prediction section as an alternative to the dynamic center-of-gravity position predicted by the first center-of-gravity position prediction section in a case in which the velocity estimation model establishment/non-establishment determination section determines that the velocity estimation model is not established, and the target operating velocity correction section corrects the target operating velocity in such a manner as to limit a maximum value of the target operating velocity in a case in which the control intervention determination section determines to execute the control intervention.

3. The work machine according to claim 2, wherein the control intervention determination section executes a floating determination to determine whether the work machine possibly floats using the dynamic center-of-gravity position predicted by the third center-of-gravity position prediction section in a case in which the velocity estimation model establishment/non-establishment determination section determines that the velocity estimation model is not established, and determines to execute the control intervention in a case of determining that the work machine possibly floats in the floating determination, and the target operating velocity correction section corrects the target operating velocity in such a manner as to limit a maximum value of the target operating velocity in a case in which the control intervention determination section determines to execute the control intervention.

4. The work machine according to claim 1, wherein the control intervention determination section executes a floating determination to determine whether the work machine possibly floats using the dynamic center-of-gravity position predicted by the second center-of-gravity position prediction section in a case in which the velocity estimation model establishment/non-establishment determination section determines that the velocity estimation model is not established, and determines to execute the control intervention in a case of determining that the work machine possibly floats in the floating determination, the target operating velocity correction section corrects the target operating velocity in such a manner that each of the plurality of actuators slowly decelerates by limiting a deceleration rate of the target operating velocity in a case in which the control intervention determination section determines to execute the control intervention.

* * * * *